US005898118A

United States Patent [19]

Tamura

[11] Patent Number: 5,898,118

[45] Date of Patent: Apr. 27, 1999

[54] COMPUTERIZED MUSIC APPARATUS COMPOSED OF COMPATIBLE SOFTWARE MODULES

[75] Inventor: Motoichi Tamura, Hamamatsu, Japan

[73] Assignee: Yamaha Corporation

[21] Appl. No.: 08/609,718

[22] Filed: Mar. 1, 1996

[30] Foreign Application Priority Data

Mar. 3, 1995 [JP] Japan ..... 7-070805
Jun. 2, 1995 [JP] Japan ..... 7-136946

[51] Int. Cl.[6] ..... G10H 7/00

[52] U.S. Cl. ..... 84/602; 84/601; 84/604; 84/615; 84/618

[58] Field of Search ..... 84/601, 602, 604–610, 84/615, 618, 622, 634

[56] References Cited

U.S. PATENT DOCUMENTS

| | | | |
|---|---|---|---|
| 5,020,410 | 6/1991 | Sasaki . | |
| 5,119,710 | 6/1992 | Tsurumi et al. . | |
| 5,376,752 | 12/1994 | Limberis et al. . | |
| 5,420,374 | 5/1995 | Hotta | 84/622 |
| 5,513,352 | 4/1996 | Tozuka | 395/600 |
| 5,596,159 | 1/1997 | O'Connell | 84/622 |

FOREIGN PATENT DOCUMENTS

| | | |
|---|---|---|
| 0 463 409 | 6/1990 | European Pat. Off. . |
| 0 597 381 | 5/1994 | European Pat. Off. . |
| 59-197090 | 11/1984 | Japan . |
| 3-39995 | 2/1991 | Japan . |
| 6-222776 | 8/1994 | Japan . |

*Primary Examiner*—Stanley J. Witkowski
*Assistant Examiner*—Marlon T. Fletcher
*Attorney, Agent, or Firm*—Graham & James LLP

[57] ABSTRACT

A computerized music apparatus utilizes resources including software modules to generate desired musical sound. In the apparatus, a primary storage is loadable with a set of software modules which are selected to perform tasks needed in generation of the desired musical sound. A central processing unit accesses the primary storage to execute the software modules stored therein to generate the musical sound. A secondary storage provisionally stores a plurality of software modules which are designed to perform a variety of tasks. A loader operates when the generation of the musical sound is initiated for selecting an effective and optimum set of software modules by searching the secondary storage according to prescribed criterion, and loads the selected software modules into the primary storage to thereby ensure effective and optimum use of the resources. Further, the computerized music apparatus is readily modified to emulate a tone generating system of a model electronic musical instrument. In the modified apparatus, an emulator operates based on device information stored in the storage for emulating a tone generating system of the model electronic musical instrument so that the emulator operates in response to event information to generate the musical tone as if sounded by the model electronic musical instrument.

20 Claims, 18 Drawing Sheets

COMPUTERIZED MUSIC APPARATUS COMPOSED OF COMPATIBLE SOFTWARE MODULES

BACKGROUND OF THE INVENTION

The present invention relates to a computerized music apparatus which generates musical sound by loading software modules for carrying out various tasks from a secondary storage device into a primary storage device. Further, the present invention relates to a computerized music apparatus which can emulate a tone generating system of existing electronic musical instrument by extended versatility.

There are various types of electronic musical instruments including high performance products and low ability products. The conventional electronic musical instruments employ hardwares which are different a product by product, and usually, their softwares are separately developed as specific ones. Since it is troublesome to independently develop softwares for different instruments, a convenient technique is disclosed in JP-A-3-39995. The technique disclosed in JP-A-3-39995 is such that a model code to specify a desired product is registered by jumper lines or switches. A CPU of the product discriminates the model code, and executes data processing according to the code. Thus, common programs can be used for multiple products different in performance. It is possible to selectively carry out various controls such as an automatic accompaniment function is installed and performed only in a product in which this function is implemented. This function is disabled in another product in which the function is not implemented. However, the technique disclosed in JP-A-3-39995 has a drawback that the control program should be fixed in advance, and it is difficult to modify the program. For example, even if only a part of the software related to the automatic accompaniment function has to be modified, it is not easy to modify only that part. Further, in the prior art, the program commonly used in the products having different performances is stored in a primary storage, so that an unnecessary part of the program may be stored in the primary storage as well. Furthermore, common use of program modules is not considered in the prior art. For instance, many similar programs have been developed separately, and they are not compatible with each other.

Today, various types of electronic musical instruments are put in practical use, and various sound sources (musical tone generators) are known and employed in the instruments. Among current products, there are some electronic musical instruments which use the same sound source commonly. However, most of the instruments generally employ a specific sound source, which is different by a product to product. Thus, configuration of a tone generating system and a data format used in the instruments also vary by a product to product. To eliminate such an inconvenience, and to improve compatibility of the data format of performance data and timbre data, GM (General MIDI) standard is established. For example, an order of timbres specified by codes is defined in the GM standard, and a MIDI apparatus is structured to select a similar timbre even if another timbre code which is not supported in the instrument is specified according to the defined order of the timbres. However, the performance data and the timbre information created for a specific platform are often incompatible in another platform, and sometimes they cannot be reproduced perfectly on another platform. This is caused by incompatibility of a sound source hardware and else. Examples of the incompatibility are listed below:

(a) Musical tone synthesizing method employed in the sound source is different among various products. There are various synthesizing principles such as PCM, FM, and physical model.

(b) Sound effector is not compatible. A sound source may accommodate various effectors such as a tone filter and a reverb circuit. If a sound source lacks the effector, it is difficult to synthesize the same sound as in another instrument.

(c) Type and number of control parameters are not compatible over various sound sources. Even if similar control parameters are used in different platforms, a control range of the parameter may be limited, or cannot be altered at all.

(d) Actual effect corresponding to a parameter is different due to hardware difference between platforms. The actual effect of similar digital filters (e.g. cutoff frequency) may vary over platforms due to difference in the filtering method or dimension of filtering.

(e) Program of CPU to control the sound source is different. The programs may vary in its tone assignment pattern, polyphony for a tone, control timings and so on.

As described above, the conventional electronic musical instruments suffer from a lot of limitations with respect to the hardware and software construction and are poor in compatibility and versatility.

SUMMARY OF THE INVENTION

In order to solve the above noted drawbacks of the prior art, a first purpose of the present invention is to achieve easy modification of softwares while saving a primary storage so that program modules can be commonly utilized for different models of electronic musical instruments.

A second purpose of the present invention is to provide a musical tone generation system with which it is possible to share performance data among different electronic musical instruments.

A third purpose of the present invention is to provide a musical tone generation system through which musical sound equivalent in timbre characteristics to that generated in another instrument can be generated by a single processing device.

A fourth purpose of the present invention is to provide a musical tone generation system with which performance data created for a particular model of instrument can be converted into a more versatile format.

A fifth purpose of the present invention is to provide a musical tone generation system with which performance data created for a particular model of instrument can be edited, thereby overcoming limitation of the particular product model, and colorful musical sound can be generated.

A sixth purpose of the present invention is to provide a musical tone generation system with which data conversion can be effected accurately so that performance data created for a particular model of instrument can be generalized with high fidelity in another model of instrument.

According to a first aspect of the invention, a computerized music apparatus utilizes resources including software modules to generate desired musical sound. The apparatus comprises a primary storage loadable with a set of software modules which are selected to perform tasks needed in generation of the desired musical sound, a central processing unit for accessing the primary storage to execute the software modules stored therein to generate the musical sound, a secondary storage for provisionally storing a plurality of software modules which are designed to perform a variety of tasks, and a loader operative when the generation of the musical sound is initiated for selecting an effective and optimum set of software modules by searching the secondary storage according to prescribed criterion, and for loading the selected software modules into the primary storage to thereby ensure effective and optimum use of the resources.

Further, the inventive computerized music apparatus utilizing resources including software modules to generate desired musical sound, comprises a primary storage loadable with a set of software modules which are selected to perform tasks needed in generation of the desired musical sound, a secondary storage provided separately from the primary storage for provisionally storing various kinds of software modules which are designed to perform a variety of tasks, a loader operative when the generation of the musical sound is initiated for selecting an effective and optimum set of software modules by searching the secondary storage, and for loading the selected software modules into the primary storage, and a central processing unit for accessing the primary storage to execute the software modules stored therein to generate the musical sound such that the central processing unit enables the software modules to communicate with each other by exchanging a message so as to integrate the set of the software modules altogether.

According to a second aspect of the invention, a computerized music apparatus is constructed to emulate a tone generating system of a model electronic musical instrument. The apparatus comprises a storage for storing device information indicative of devices contained in the model electronic musical instrument and for storing performance information originally prepared to feed the model electronic musical instrument, a processor for retrieving the performance information from the storage and for processing the retrieved performance information to produce event information which commands generation of a musical tone, and an emulator operative based on the device information stored in the storage for emulating the tone generating system of the model electronic musical instrument so that the emulator operates in response to the event information to generate the musical tone as if sounded by the model electronic musical instrument. In a specific form, the emulator includes a driver software module for emulating a driver device involved in the tone generating system so that the driver software module controls the generation of the musical tone. In another specific form, the emulator includes a register software module for emulating a register device involved in the tone generating system so that the register software module memorizes control parameters used for control of the generation of the musical tone. In a further specific form, the emulator includes a generator software module for emulating a generator device involved in the tone generating system so that the generator software module creates a waveform of the musical tone to be generated. In a still further specific form, the emulator comprises a single computer for commonly emulating different tone generating systems of a plurality of model electronic musical instruments.

Further, the inventive computerized music apparatus constructed to emulate a timbre created by a model electronic musical instrument, comprises first means for setting up a basic tone generating system, second means for providing original timbre information which characterizes a timbre of musical tones generated by a specific tone generating system of the model electronic musical instrument, third means for converting the provided original timbre information into equivalent timbre information which is effective in the basic tone generating system, and fourth means for providing event information effective to command generation of musical tones, so that the basic tone generating system operates in response to the event information and according to the equivalent timbre information for generating the musical tones having a timbre as if created by the specific tone generating system of the model electronic musical instrument. In a specific form, the third means includes optional means for reversely converting the equivalent timbre information into different timbre information which is designed for use in another model electronic musical instrument different from the first-mentioned model electronic musical instrument. In another specific form, fifth means is manually operable to rewrite values of the equivalent timbre information to modify the timbre created by the basic tone generating system.

In the computerized music apparatus according to the first aspect of the present invention, the software modules are loaded into the primary storage, and are executed by the CPU to generate musical sound. The software modules are provisionally stored in the secondary storage, and are loaded into the primary storage upon power-on of the apparatus or upon a certain user command entry. The module to be loaded is determined according to one or more item of the predetermined criteria. Thus, the tone generating system is set up for execution so that modifying of software modules is very easy. Unnecessary program is not loaded into the primary storage, and just a required software is loaded.

In the arrangement according to the second aspect of the invention, a combination of the device information specifying an electronic musical instrument to be emulated and the performance information created for a specific platform of the emulated electronic musical instrument is stored in a data media. Then, the device and performance information is read out from the data media, and event information commanding musical tone generation is produced according to the performance information. Using the device information, it is possible to process the performance information by the inventive computerized music apparatus. Further, with setting up the tone generating system according to the device information, it is possible to reproduce musical sound having equivalent characteristics to a model instrument. In the inventive arrangement, an electronic musical instrument to be emulated is specified. When musical sound generation is commanded, a musical sound signal waveform is generated by emulating the operation of the sound source of the specified electronic musical instrument in response to the sound generation command. The musical sound is reproduced according to the generated musical sound signal waveform. Thus, it is possible to process the performance information in manner identical to the specified electronic musical instrument. In the inventive arrangement, the musical sound signal waveform generating process emulates operations of a processor controlling the sound source of the specified electronic musical instrument, so that the musical sound signal waveform corresponding to various processors can be generated. In the inventive arrangement, the musical sound signal waveform generating process emulates operations of control registers storing plural control parameters in the sound source of the specified electronic musical instrument, so that processings according to the contents of the control registers can be commonly used for different electronic musical instruments. In the inventive arrangement, the musical sound signal waveform generating process emulates a method of musical sound generation of the sound source of the specified electronic musical instrument, so that various sound sources operating according to various methods can be emulated very accurately. In the inventive arrangement, the musical sound signal waveform generating process is executed by a single computer, with which operations of different sound sources of electronic musical instruments are emulated, so that it is possible to emulate many models of electronic musical instruments with the inexpensive arrangement.

In the inventive arrangement, firstly an electronic musical instrument to be emulated is specified, first timbre information of the specified first electronic musical instrument is distributed, and then musical sound generation is commanded. The first timbre information is converted into basic or equivalent timbre information for use in a basic tone generating system which emulates the sound source arrangement in the first electronic musical instrument. Then, the operation of the basic tone generating system is executed in order to produce a musical sound signal waveform in response to the sound generation command. The musical sound is reproduced according to the generated musical sound signal waveform. Thus, timbre information created for a particular model of instrument can be converted into a more versatile format. In the inventive arrangement, the basic timbre information may be converted into second timbre information of a second electronic musical instrument which is different from the first electronic musical instrument, so that specific timbre information created for a particular model of instrument can be translated with high fidelity for use in another model of instrument. In the inventive arrangement, a value of the basic timbre information is edited in response to manual operating means, so that the original timbre information created for a particular model of instrument can be freely edited, thereby overcoming the limitation of the particular model, and colorful musical sound can be generated.

DESCRIPTION OF EMBODIMENTS

Figure 1:
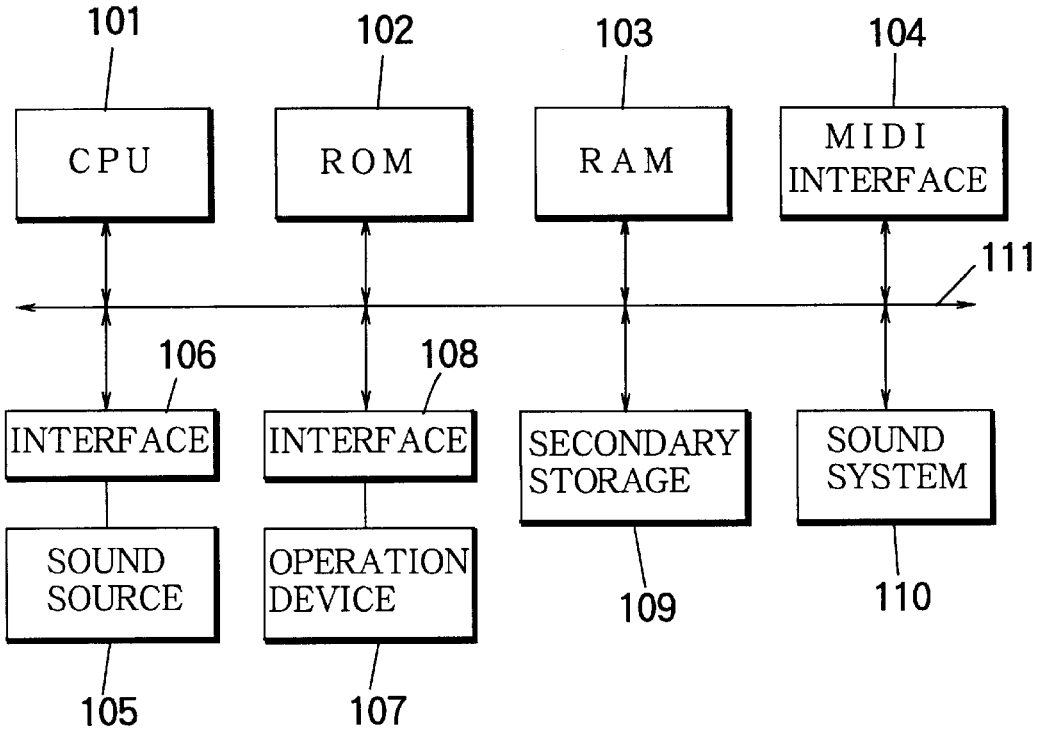
FIG. 1 is a schematic block diagram of the electronic musical instrument as a first embodiment according to the present invention.

Hereinafter, embodiments of the present invention will be described with reference to Figures. FIG. 1 is a schematic block diagram showing a hardware construction of an electronic musical instrument according to a first embodiment of the present invention. The instrument comprises a Central Processing Unit (CPU) 101, a Read Only Memory (ROM) 102, a Random Access Memory (RAM) 103, a MIDI (Musical Instrument Digital Interface) interface 104, a sound source 105, an interface 106 to the sound source 105, an operation device 107, another interface 108 to the operation device 107, a secondary storage 109 and a sound system 110. These hardware modules are connected to each other through a bus line 111.

CPU 101 controls the whole system of the electronic musical instrument. The operation of the CPU 101 will be described in detail later with referring to flowcharts. The ROM 102 stores a booting program (FIG. 5), which will be described later as well. Various software modules are loaded into a primary storage in the form of the RAM 103. The various software modules are provisionally stored in the secondary storage 109. The secondary storage 109 may be structured by a hard disk drive, for instance.

The sound source or tone generator 105 receives commands from the CPU 101 via the interface 106, and generates a signal of musical sound. The sound system 110 acoustically reproduces the musical sound signal generated by the sound source 105. In this embodiment, the sound source 105 is implemented by using a hardware module. However, the sound source 105 can be implemented by using a software module.

The operation device 107 may be composed of various kinds of manual input hardwares such as a keyboard having keys and being played by a user. Input information fed from the operation device 107 is sent to the CPU 101 via the interface 108. External MIDI instruments can be coupled to the MIDI interface 104.

Figure 2:
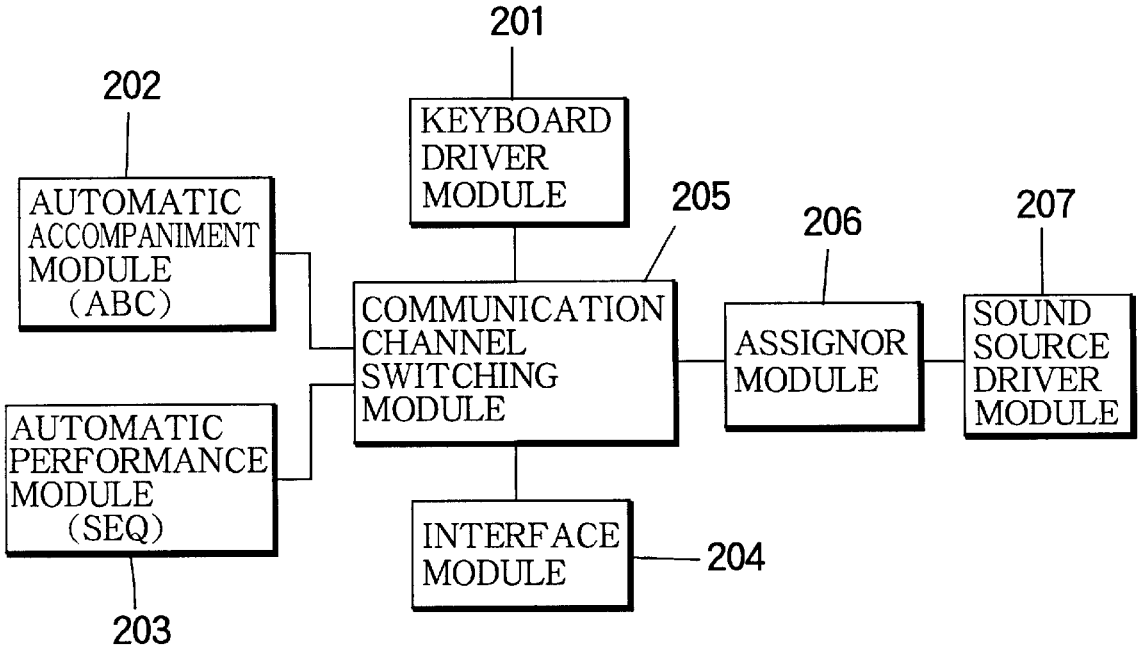
FIG. 2 shows a block diagram of software construction set up on the hardware construction shown in FIG. 1.

FIG. 2 shows a block diagram of a software construction implemented in the hardware structure shown in FIG. 1. The software construction includes a keyboard driver module 201, an automatic accompaniment (ABC: Auto Bass Chord) module 202, an automatic performance (SEQ: Sequencer) module 203, a MIDI interface module 204, a communication channel switching module 205, an assignor module 206, and a sound source driver module 207. Each software module is loaded from the secondary storage 109 into the RAM 103, and is executed by the CPU 101.

The keyboard driver module 201 is actually a controlling program designed to control the keyboard included in the operation device 107. The automatic accompaniment (ABC) module 202 is executed to perform a specific task of an automatic accompaniment. The automatic performance (SEQ) module 203 takes control of automatic playing. The MIDI interface module 204 is a software module to control the MIDI interface 104 shown in FIG. 1. The assignor module 206 performs a task to allocate or assign tone generation channels of the sound source to each note-on command received by the sound source. The sound source driver module 207 is a driver software to control the sound source 105, and executes the note-on command according to a command from the assignor module 206.

Figure 6:
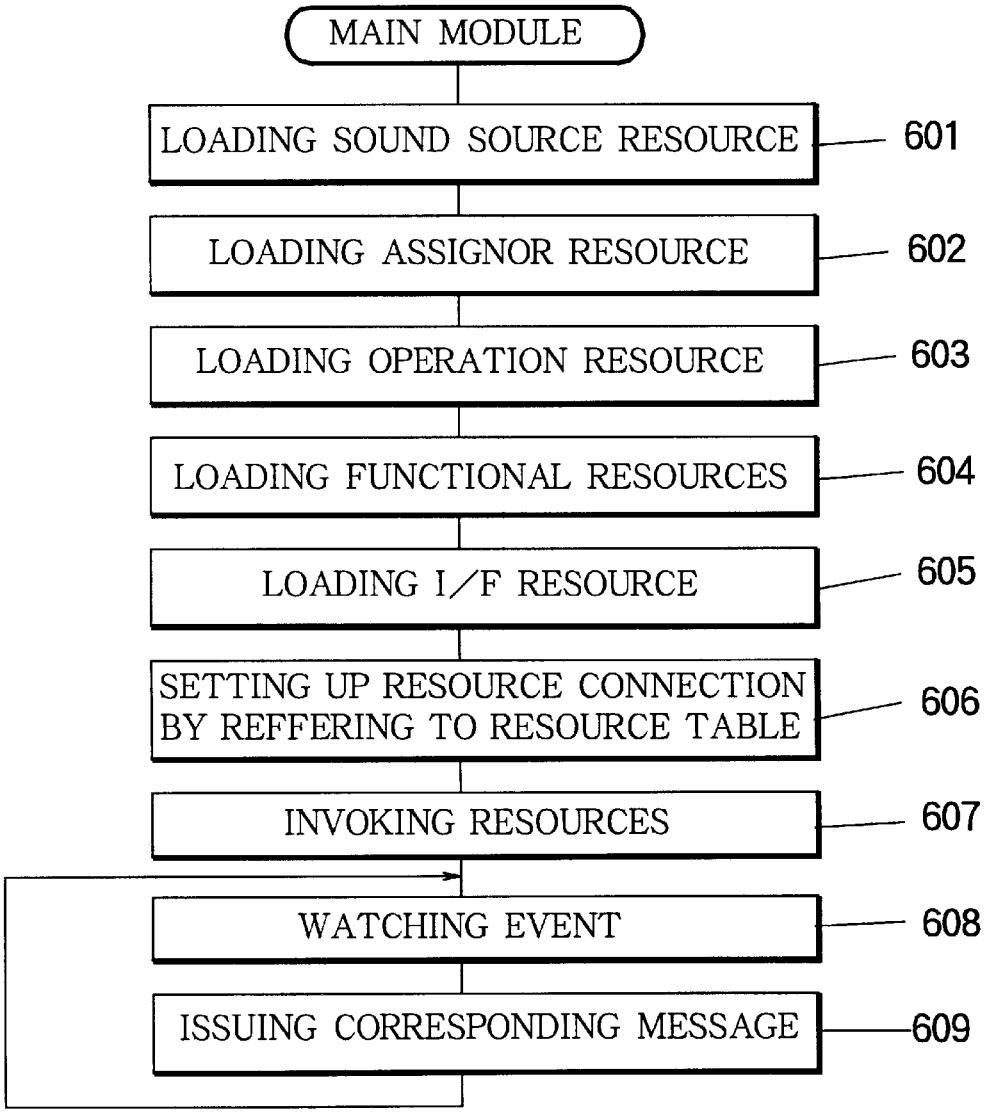
FIG. 6 is a flowchart showing operation of a main module.

The communication channel switching module 205 switches a message exchanging path among the various software modules. Particularly, the communication channel switching module 205 is implemented by a main module (FIG. 6). For instance, the communication channel switching module 205 performs a switching task including:

(1) Upon receiving key depression information from the keyboard driver module 201, the switching module 205 sends the information to the assignor module 206.

(2) Upon receiving key depression information of an accompaniment chord, the switching module 205 sends the information to the automatic accompaniment module 202.

(3) Upon receiving a note-on command of an automatic accompaniment from the automatic accompaniment module 202, the switching module 205 sends the command to the assignor module 206.

Figure 3:
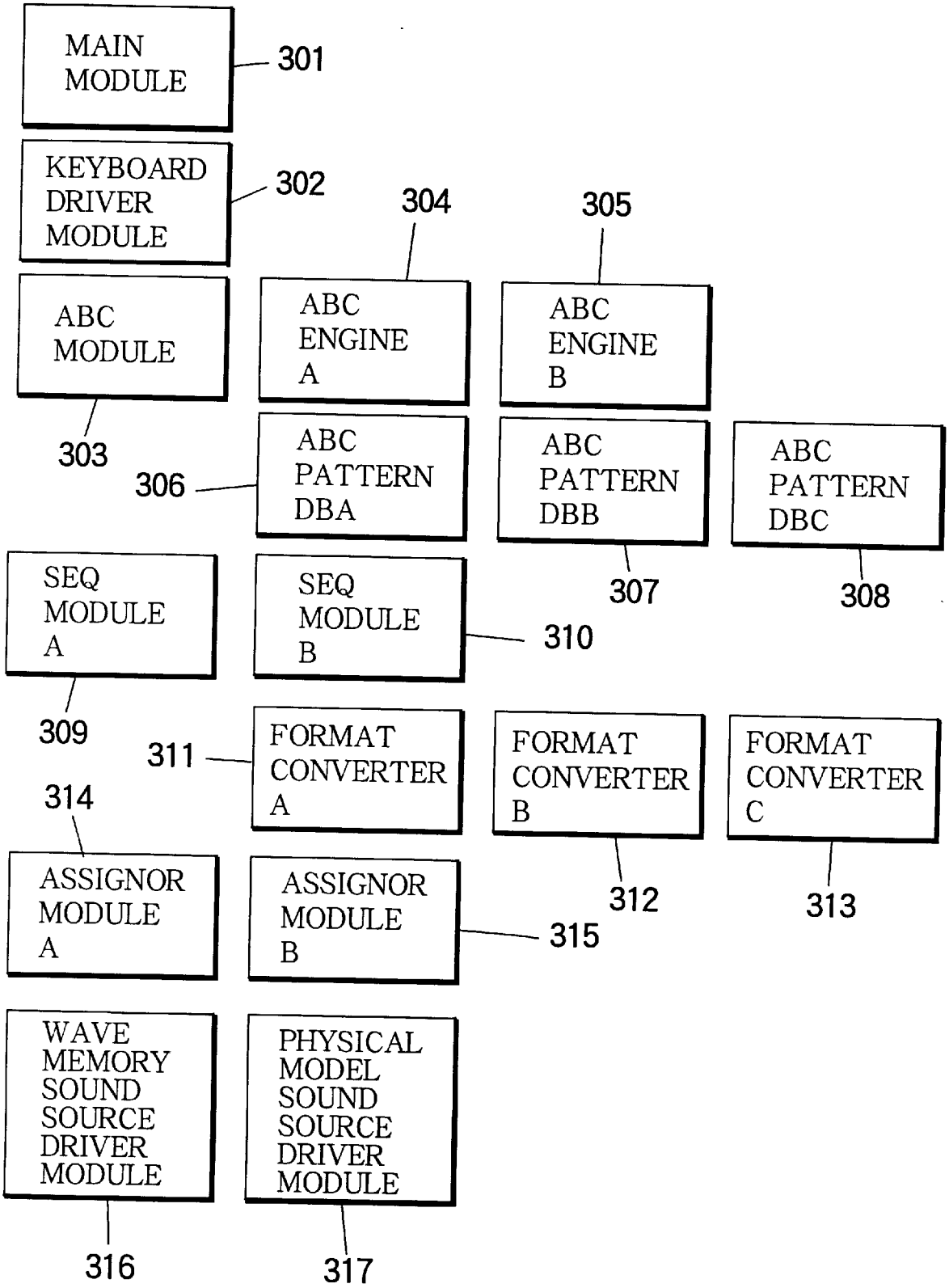
FIG. 3 shows an example of software modules stored in a secondary storage.

FIG. 3 shows software resources in the form of a variety of software modules provisionally stored in the secondary storage 109 of the electronic musical instrument. Selected ones of these software module are loaded from the secondary storage 109 to the RAM 103 to constitute the software construction shown in FIG. 2, which is composed of an effective and optimum set of the selected software modules. In FIG. 3, a main module 301 is selected as the communication channel switching module 205, and controls information or message exchange among the software modules. A single keyboard driver module 302 is selected as the keyboard driver module 201 in the FIG. 2 structure. An ABC module 303 is selected as the automatic accompaniment (ABC) module 202. When the ABC module 303 is loaded into the primary storage, an ABC engine and ABC patterns should be also loaded into the primary storage as a submodule. The submodule is a lower level module integrated into a higher level module, and is operated dependently on the higher level module. Numerals 304 and 305 denote two types of ABC engine submodules. Numerals 306 to 308 denote three types of ABC pattern submodules. The ABC module 303, one or more of the two ABC engine submodules 304, 305 and one or more of the three ABC pattern submodules 306–308 are selectively loaded into the primary storage to constitute the composite automatic accompaniment (ABC) module 202 shown in FIG. 2.

Numerals 309 and 310 denote two types of automatic performance (SEQ) modules. Numerals 311 to 313 denote three types of format converters, which are a submodule subordinate to the SEQ module. A format of automatic performance data may vary over models and makers of the instrument, so that an adequate format converter should be selected to translate one format of the automatic performance data to another format which can be treated by the SEQ module. One of the two SEQ modules 309 and 310 and one or more of the three format converters 311–313 are selected to define the automatic performance (SEQ) module 203 shown in FIG. 2. Occasionally, no format converter is required if the SEQ module can directly treat the original format of the automatic performance data.

Numerals 314 and 315 denote two types of assignor modules, and one of the assignor modules 314 and 315 is selected as the assignor module 206 shown in FIG. 2. Numerals 316 and 317 denote two types of sound source driver modules, and one or more of the sound source driver modules 316 and 317 is selected as the sound source driver module 207. Particularly, the sound source driver module 316 is designed for a waveform memory read-out type sound source, and the other sound source driver module 317 is designed for a physical model type sound source.

In this embodiment, the various software modules shown in FIG. 3 are provisionally stored in the secondary storage 109. In response to power-on of the instrument or user command entry, suitable software modules are selectively loaded into the primary storage in the form of the RAM 103 to set up the electronic musical instrument. A loader is installed in the instrument and operates when generation of musical sound is initiated for selecting an effective and optimum set of software modules by searching the secondary storage according to the following prescribed criteria:

(1) Examining equipped hardwares, the loader selects modules corresponding to the equipped hardwares. For example, after checking the sound source board installed in the instrument, if a waveform memory read-out type sound source is equipped, the corresponding sound source driver module 316 is chosen to be loaded. Namely, the loader operates according to a physical criterion for examining hardware modules included in resources of the instrument to identify effective hardware modules used in the generation of the musical sound, and for selecting effective software modules corresponding to the identified effective hardware modules.

(2) If there are software modules performing tasks of similar type, the loader selects the one having higher performance or the one having a newer time stamp. Namely, the loader operates according to a performance criterion if the secondary storage stores two or more of similar software modules performing substantially identical tasks but having different degrees of performance and different ages of creation for selecting optimum one of the similar software modules having either of the highest degree of performance and the youngest age of creation.

(3) If a software module requires several submodules, the loader seeks the submodules existing in the secondary memory. Then, the loader selects the software module whose submodule exists in the secondary memory. Namely, the loader operates according to an integrity criterion for selecting a software module together with one or more of an indispensable software submodule only if the indispensable software submodule is stored in the secondary storage.

(4) The loader does not load a software module subordinate as for signal flow to a certain software module if the same is not available. Namely, the loader operates according to a criterion for selecting a software module which is positioned at an upstream of data process flow relative to another software module only if said another software module is stored in the secondary storage.

(5) The loader does not load an incompatible module for combining with other modules. Namely, the loader operates according to a compatibility criterion for selecting a software module only if the same is compatible with other software modules selected from the secondary storage.

The secondary storage 109 redundantly stores various software modules. However, the storage cost per bit of the secondary storage is cheap, so that it does not cost much to store modules which may not be used. On the other hand, the storage cost of the primary storage (RAM) is expensive and the capacity is limited. Thus, according to the present invention, suitable software modules are loaded from the secondary storage into the RAM upon power-on or upon a user command entry, in order to set up an electronic musical instrument.

Figure 4:
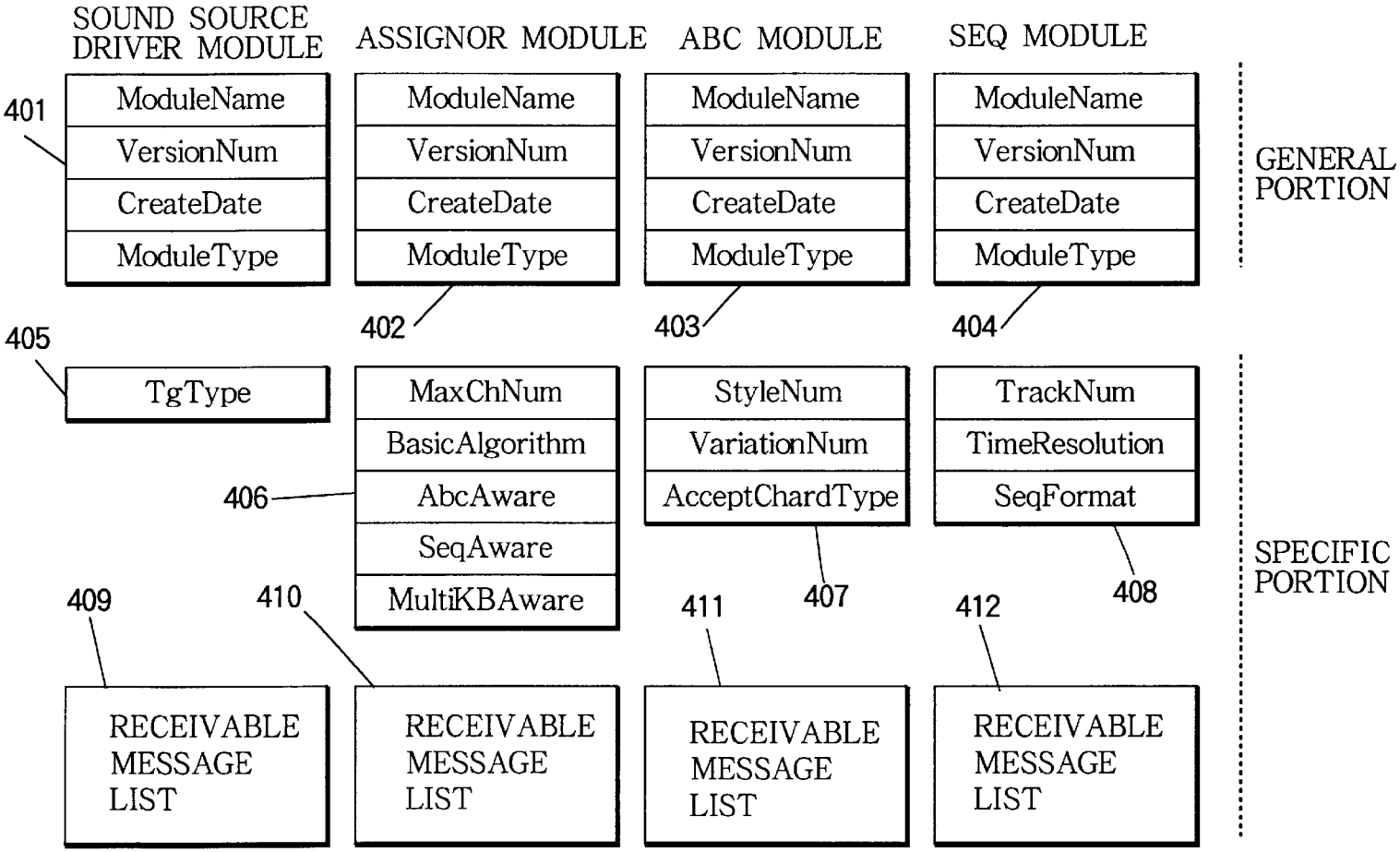
FIG. 4 shows an example of attribute information of the software modules.

FIG. 4 shows an example of attribute information of the software modules. The attribute information is referred to by the loader for determining whether a module is to be loaded or not according to the criteria (1) to (5) described above. The attribute information comprises a general portion common in all the software modules, and a specific portion. In FIG. 4, numeral 401 denotes a general portion of the attribute information of the sound source driver module. A message ModuleName denotes the name of the module, VersionNum specifies the version number, CreateDate specifies the date of the module creation, and ModuleType specifies the type of the module such as a main module, a keyboard driver module and an ABC module. The general portions 402–404 of the attribute information of the assignor module, ABC module, and SEQ module have the same structure as the attribute information 401 of the sound source driver module.

Numeral 405 in the attribute information of the sound source driver module denotes a message TgType specifying the type of the sound source supported by the driver such as waveform memory read-out type or physical model type.

Numeral 406 denotes a specific portion of the attribute information of the assignor module. A message MaxChNum specifies the number of the tone generation channels which the assignor module can control, BasicAlgorithm specifies the basic algorithm of the channel assignment (e.g., priority in the order of the data arrival), AbcAware is a flag identifying whether the module has a facility to detect an automatic accompaniment sound signal and to assign it, SeqAware is a flag signifying whether the module has a facility to detect an automatic performance sound signal and to assign it, and MultiKBAware is a flag specifying whether the module has a facility to detect as to whether upper or lower region of multiple keyboards is manipulated.

Numeral 407 denotes the specific portion of the attribute information of the ABC module. A message StyleNum specifies the number of the automatic accompaniment styles, VariationNum specifies the number of variations of the automatic accompaniment, and AcceptChordType specifies the number of the chord types supported by and used in the automatic accompaniment.

Numeral 408 denotes the specific portion of the attribute information of the SEQ module. An entry message TrackNum specifies the number of tracks of the automatic accompaniment, TimeResolution specifies the time resolution of the automatic accompaniment, SeqFormat specifies the data format of the automatic accompaniment data.

Numerals 409 to 412 respectively denote a list of messages receivable by each module and included in the specific portion of the attribute information of the sound source driver module, the assignor module, the ABC module, and the SEQ module. In this embodiment, an interface among the software modules is unified in order to improve the compatibility of the modules. Namely, a message passing method is employed. The receivable message lists 409 to 412 indicate messages which can be received and processed by each module. By accessing the message list, the system can obtain knowledge about detailed facilities implemented in the modules. By employing the message passing method for the interface between the modules, the compatibility of the software module can be improved very much. Namely, the CPU enables the software modules to communicate with each other by exchanging messages so as to integrally execute the set of the software modules loaded in the primary storage.

Now, examples of the communication messages handled by each module will be described hereunder.

(1) Messages receivable or admissable by the sound source driver module, and procedures conducted according to the received messages
  (11) GetTgInfo( ): Get various information about the sound source.
  (12) GetToneColorList( ): Get a list of tone colors createable by the sound source.
  (13) GetToneInfo (ToneColorNum): Get information for a specific tone color.
  (14) GenerateTone (ToneInformation): Synthesize a note or generate a tone according to ToneInformation, which indicates a tone generation command.
  (15) DumpTone (ToneInformation): Dump a note according to ToneInformation.
  (16) GetChannelStatus (ChannelNum): Get the status of the tone generation channel corresponding to ChannelNum.

(2) Messages receivable by the automatic performance (SEQ) module, and procedures executed by the same according to the received messages
  (21) StartAllTrack (SongNum): Start to play the song data corresponding to SongNum.
  (22) StartSpecificTrack (SongNum, TrackInfo): Start to play a specified track of the song data corresponding to SongNum.
  (23) StopAllTrack( ): Stop to record/play all tracks.
  (24) StopSpecificTrack (SongNum, TrackInfo): Stop to record/play a specified track.
  (25) Pause( ): Pause to record/play all tracks.
  (26) RecordAllTrack (SongNum): Start to record all tracks.
  (27) RecordSpecificTrack (SongNum, TrackInfo): Start to record a specified track.
  (28) MoveSongPointer (SongNum, Location): Move an address pointer to a specified address location of specified song data.

(3) Messages received by the automatic accompaniment (ABC) module, and procedures executed corresponding to the messages
  (31) SetAbcType (AbcTypeInfo): Set up automatic accompaniment according to AbcTypeInfo.
  (32) ExpandAbc (ChordInfo): Generate an automatic accompaniment pattern according to ChordInfo (chord information).
  (33) GetAbcStyle( ): Get a list of available automatic accompaniment styles.
  (34) GetAbcType( ): Get a list of available automatic accompaniment types.

(4) Messages received by the assignor module, and procedures executed corresponding to the received messages.
  (41) GetChannelMaxNum( ): Get the maximum number of the tone generation channels.

(42) GetIdleChannel( ): Get information about idling or available tone generation channels.

(43) AssignChannel (ToneInformation): Assign ToneInformation to an idling tone generation channel.

(44) Truncate (TruncateAlgorithm): Truncate a certain note according to TruncateAlgorithm.

Figure 5:
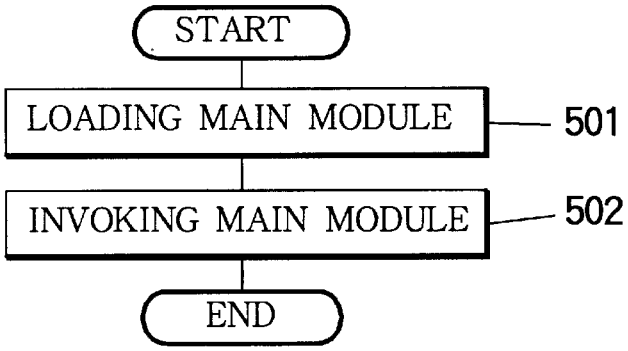
FIG. 5 is a flowchart showing a booting program of the instrument.

Now, the operation of the electronic musical instrument according to the first embodiment will be described in conjunction with flowcharts of FIGS. 5 to 10 in detail. FIG. 5 is a flowchart showing a booting process of the system. A booting program is stored in the ROM 102, and launched upon power-on or upon the user command, namely a reset command. First of all, in STEP 501, the CPU 101 loads the main module 301 shown in FIG. 3 from the secondary storage 109 into the primary storage. The main module is invoked or commenced in STEP 502.

FIG. 6 is a flowchart showing the operation of the main module invoked in the STEP 502. The main module loads various software modules sequentially from a downstream to an upstream with respect to data flow of the system. The software modules are selectively loaded from the secondary storage 109 to the primary storage of RAM 103. In STEP 601, a sound source resource is loaded. Then, an assignor resource is loaded in STEP 602. The resource loading will be explained later with referring to FIGS. 8 and 9A. In STEP 603, an operation resource is loaded. In this step, the keyboard driver module 302 shown in FIG. 3 is loaded, and other drivers concerning various operation hardwares may be also loaded. In STEP 604, functional or application resources are loaded. In this step, the automatic accompaniment resource and the automatic performance resource are loaded, and the resource loading will be explained later with referring to FIGS. 9B and 10. In STEP 605, an interface (I/F) resource such as a MIDI driver module is loaded.

In STEP 606, the main module sets up the resource connection by accessing a resource table. The resource table is allocated in the RAM 103 to store the name and type of the software modules loaded in STEPs 601 to 605. By accessing the resource table, the main module recognizes which module is loaded currently. In setting up the state of the resource connection in STEP 606, message paths are set up, through which the communication messages are exchanged among the loaded modules.

Each resource is invoked in STEP 607. Then, the procedure loops through STEP 608 to watch a MIDI event. In STEP 609, messages corresponding to the occurring event are passed to a concerning module. For instance, upon keyboard manipulation, a key depression event is detected in STEP 608, and a message corresponding to the key depression event is issued. Namely, key depression information is passed to the automatic accompaniment module upon an accompaniment key manipulation. Otherwise, the key depression information is passed to the assignor module upon a normal key manipulation.

Figure 7:
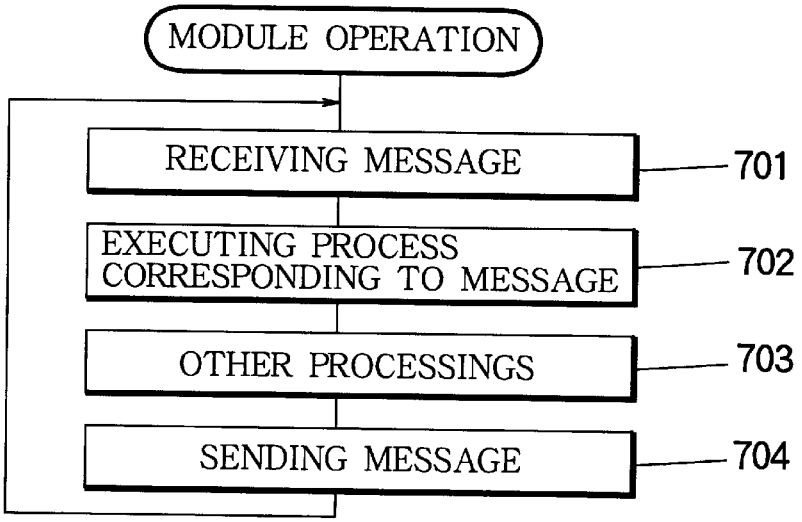
FIG. 7 is a flowchart showing operation of each software module.

FIG. 7 is a flowchart showing the operation of each module. Upon receiving the invoke command generated in STEP 607, each module executes procedures shown in FIG. 7. Any message is received in STEP 701, and the process corresponding to the received message is executed in STEP 702. Other processes may be carried out in STEP 703. Any message required to pass is sent out in STEP 704. Then, the procedure returns to STEP 701, and the same steps are repeated. For example, in the ABC module, upon receiving chord key depression information from the keyboard in STEP 701, the ABC module expands an inputted chord pattern to an automatic accompaniment note pattern. The ABC module executes other procedure in STEP 703, and then sends the expanded accompaniment notes to the assignor module.

Figure 8:
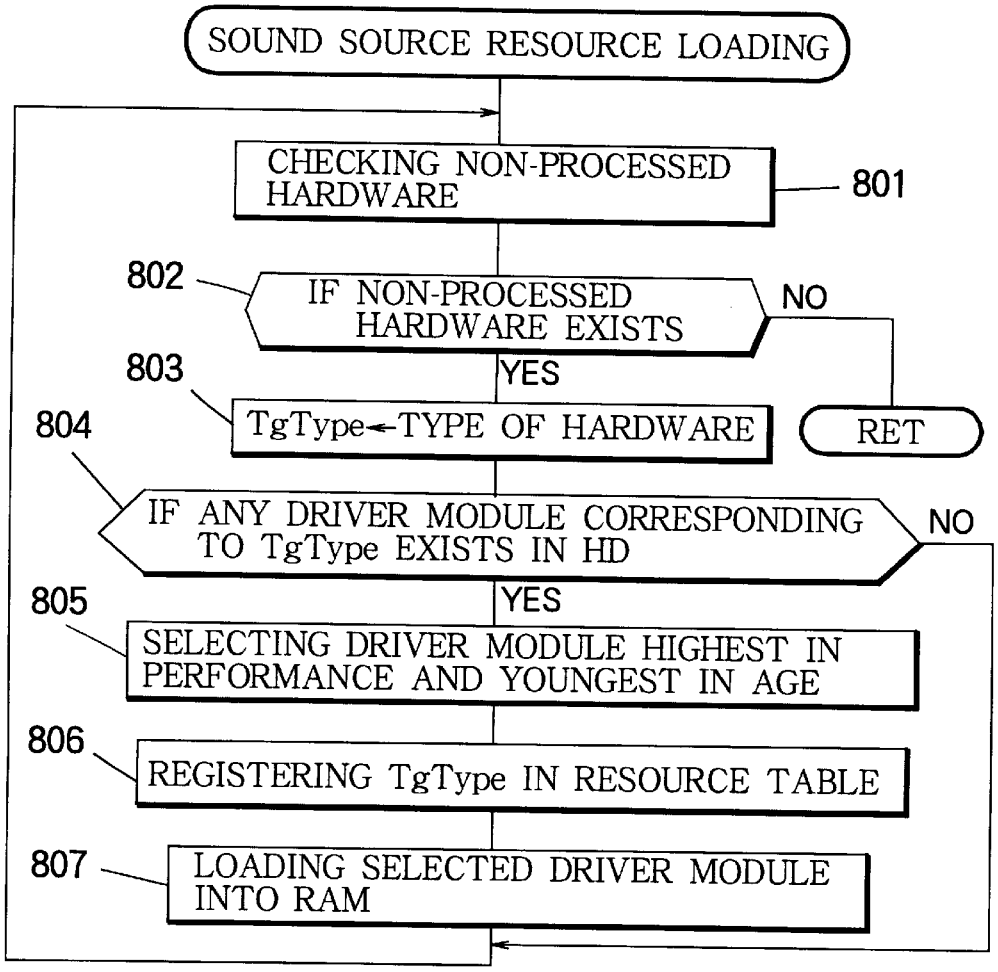
FIG. 8 is a detailed flowchart showing loading procedure of the sound source resource.

FIG. 8 is a detailed flowchart showing the loading procedure of the sound source resource conducted in the STEP 601 of FIG. 6. In STEP 801, the CPU examines if there is a sound source which is not yet processed by checking any sound source connected to the hardware interface. After all the sound source resources are processed, the procedure returns via STEP 802. If there is any non-processed sound source hardware, the routine forwards to STEP 803. In STEP 803, the type of the sound source (e.g., waveform memory read-out type or physical model type) is stored in a register TgType. The register TgType is a work register, and is different from the attribute information TgType shown in FIG. 4 of the sound source driver module stored in the secondary storage. In STEP 804, the CPU detects as to existence of the sound source driver module specified by the register TgType in the secondary storage 109. This detection is done by reading out the attribute information TgType of the sound source driver modules from the secondary storage 109, and by comparing its value with that of the work register TgType, in order to search a corresponding sound source driver module. If it is detected that any corresponding sound source driver module exists in HD of the secondary storage 109 in STEP 804, the procedure forwards to STEP 805. If no sound source driver module is found, the routine returns to STEP 801. In case that plural drivers exist, a driver highest in performance and newest in time stamp is s elected in STEP 805. The capability and age of the driver module can be detected by accessing the attributes VersionNum and CreateDate. In STEP 806, the name and the type TgType of the selected sound source driver module are registered in the resource table. In STEP 807, the selected sound source driver module is loaded from the secondary storage 109 into the RAM 103, and the procedure returns to STEP 801.

Figure 9A:
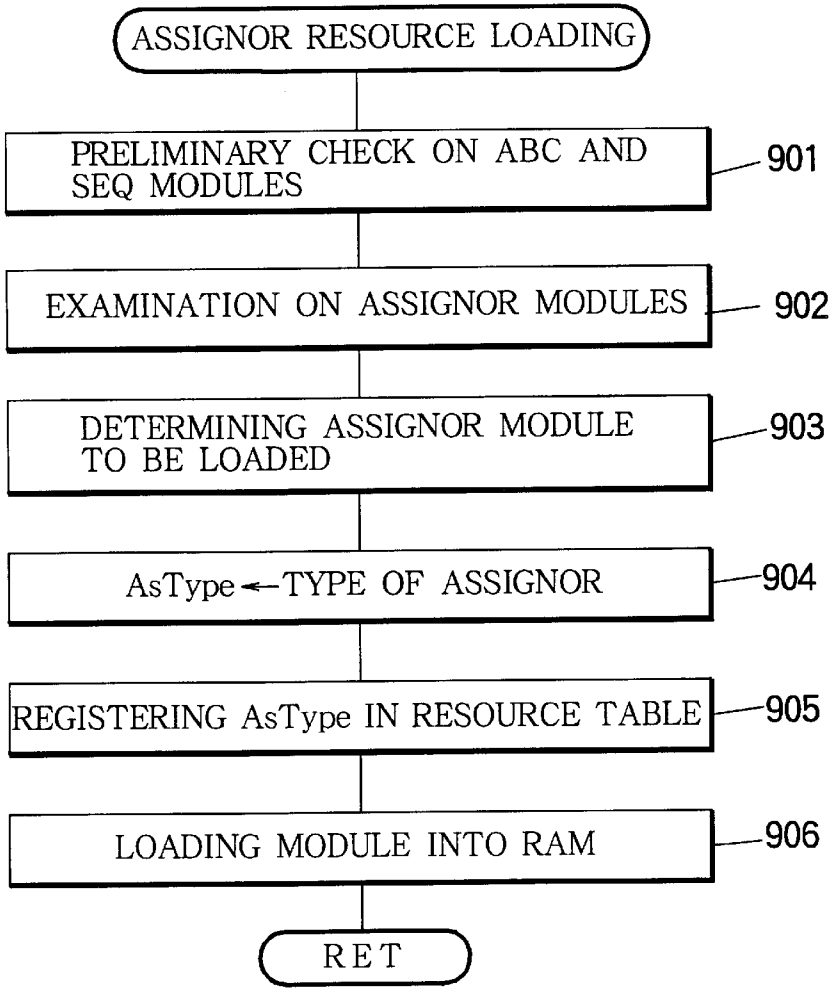
FIGS. 9A and 9B are detailed flowcharts showing loading procedure of the assignor resource and the automatic accompaniment resource.

FIG. 9A is a detailed flowchart showing the loading procedure of the assignor resource shown in STEP 602 of FIG. 6. In STEP 901, the CPU conducts preliminary check on application software modules such a s ABC and SEQ modules stored in the secondary storage 109. Assignor modules stored in the secondary storage 109 may vary from a high performance version which can assign the automatic accompaniment notes or automatic performance notes separately from a regular key note, to a low performance or simplified version having just an ability to assign a received key code. However, if there is no ABC or SEQ module at all, loading of a high performance assignor module just wastes the memory capacity of RAM 103. In that case, a low performance assignor just does the job. This is the reason why the preliminary check is conducted in STEP 901. In STEP 902, assignor modules stored in the secondary storage 109 are examined. In STEP 903, the assignor module to be loaded is determined. Particularly in this determination, the required performance level of the assignor is determined as the result of the preliminary examination in STEP 901. Then, the assignor with that performance level is searched in the secondary storage 109. If plural assignors are detected, an optimum assignor module having the highest performance and the newest age is selected. In STEP 904, the type of the selected assignor module is stored in a work register AsType, and the name and the type AsType are registered in the resource table in STEP 905. In STEP 906, the selected assignor module is loaded from the secondary storage 109 into the RAM 103, and the procedure is completed.

Figure 9B:
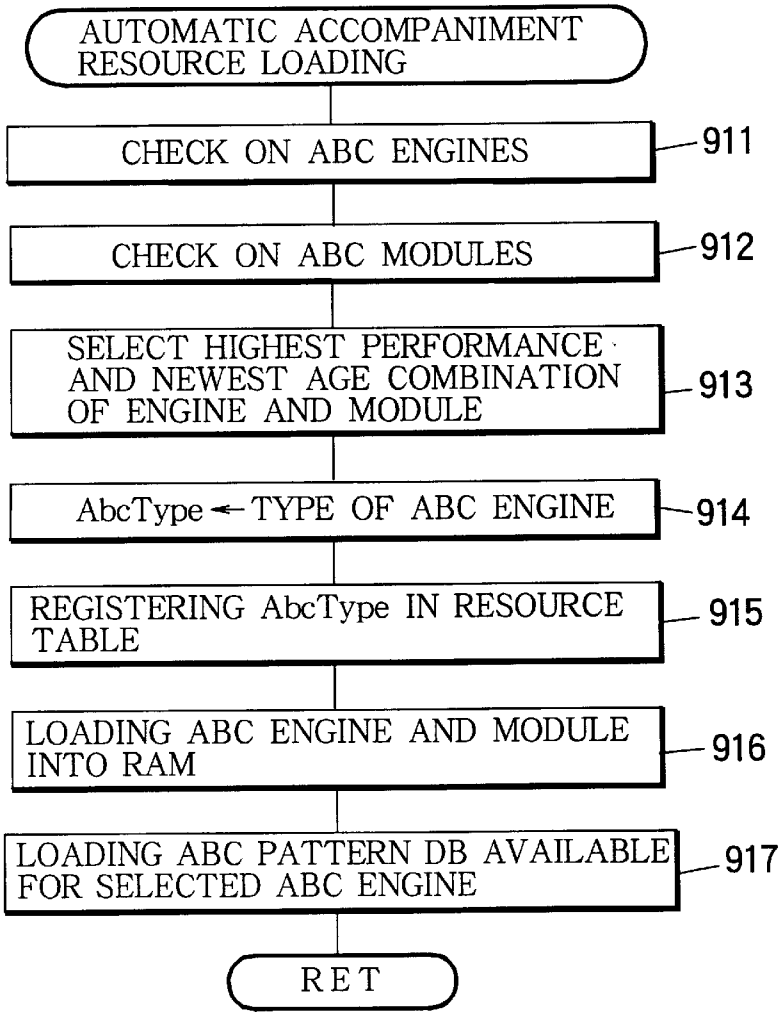

FIG. 9B is a detailed flowchart showing the loading procedure of the automatic accompaniment resource shown in the STEP 604 of FIG. 6. In STEP 911, the ABC engines stored in the secondary storage 109 are examined, and then the ABC modules stored in the secondary storage 109 are examined in STEP 912. In STEP 913, a combination of the module and the submodule highest in performance and newest in time stamp is selected to determine the compatible combination of the ABC module and the ABC engine found by the examination. In STEP 914, the type of the selected ABC engine is stored in a work register AbcType. In STEP 915, the name and the type AbcType are registered in the resource table. In STEP 916, the selected ABC module and the ABC engine are loaded from the secondary storage 109 into the RAM 103. Further in STEP 917, any ABC pattern DB (database) available for the selected ABC engine is loaded from the secondary storage 109 into the RAM 103. Occasionally, two or more ABC pattern submodules may be loaded.

Figure 10:
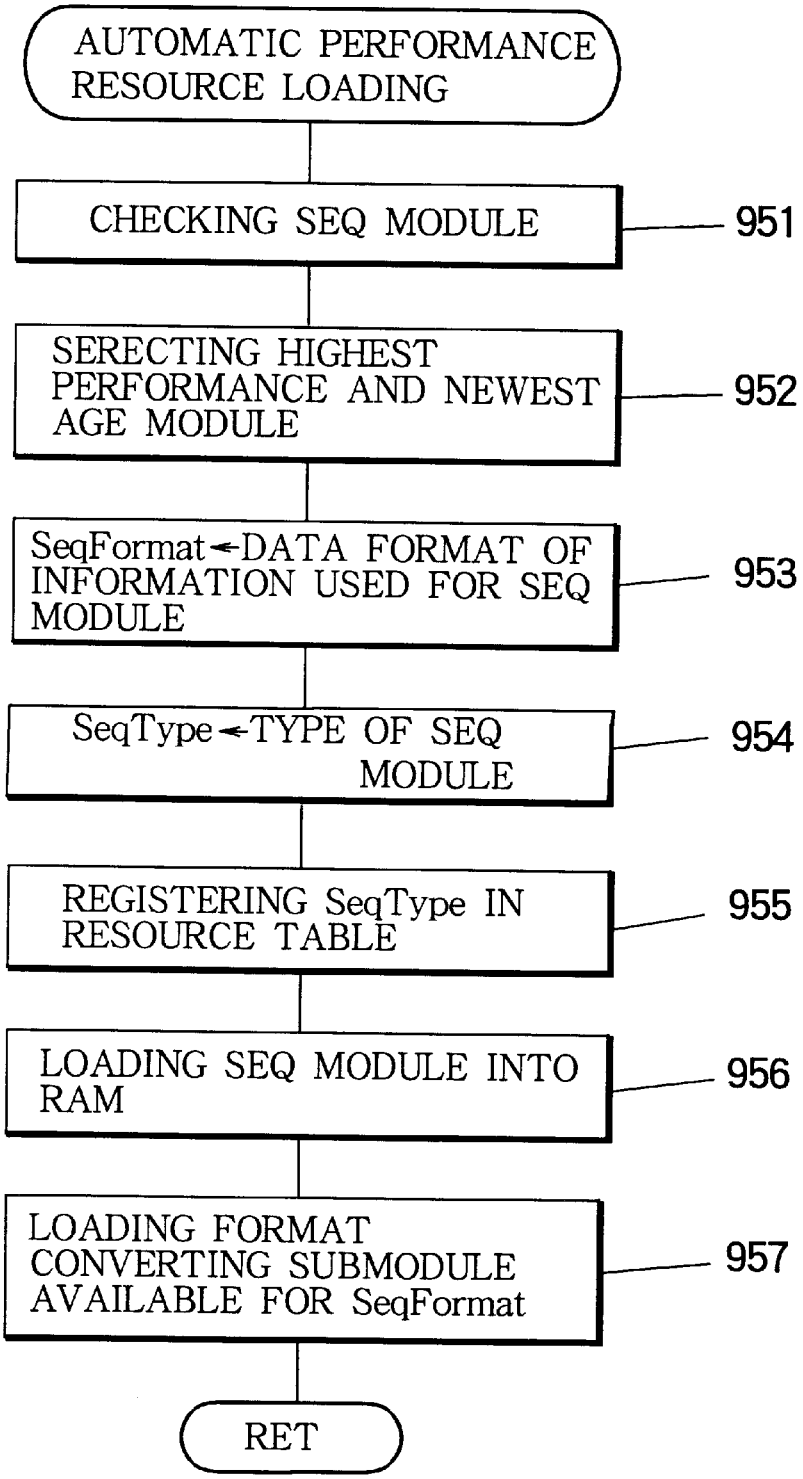
FIG. 10 is a detailed flowchart showing loading procedure of the automatic performance resource.

FIG. 10 is a detailed flowchart showing the loading procedure of the automatic performance resource executed in the STEP 604 of FIG. 6. In STEP 951, SEQ modules stored in the secondary storage 109 are examined. If plural SEQ modules are detected, an optimum module highest in performance and newest in age is selected in STEP 952. In STEP 953, information about the data format of the automatic performance data compatible to the selected SEQ module is stored in a work register SeqFormat. In STEP 954, the type of the selected SEQ is stored in a work register SeqType. In STEP 955, the name and the type SeqType are registered in the resource table. In STEP 956, the selected SEQ module is loaded from the secondary storage 109 to the RAM 103. Further in STEP 957, the format converter submodule compatible to the automatic performance data having a format specified by the work register SeqFormat is loaded from the secondary storage 109 to the RAM 103, and the procedure finishes. Occasionally, two or more converter modules may be loaded into the primary storage.

According to the first embodiment, modifying of the software modules is very easy. For instance, an old version of a sequencer program can be easily updated to a new version by just storing the new version of the sequencer program in the secondary storage of the electronic musical instrument. The new version of the sequencer program is automatically loaded into the primary storage upon power-on or resetting of the system. The present invention can be applied to a multi-purpose computer system which may be called an electronic musical instrument in a broad sense. For instance, the present invention is applied to a general-purpose computer system provided with a sound source board and a hard disk. It is possible to store each software module described above in the secondary storage, and to select, load, and execute suitable software modules upon receiving a command to play musical notes from a user. Software modules can be easily distributed by a portable memory media such as floppy disk, and can be copied into a hard disk.

As described in the foregoing, according to the first aspect of the present invention, the software tone generating system is set up freely so that modifying of software modules is very easy. Since required software modules are selectively loaded from the secondary storage to the primary storage, no unnecessary program is loaded into the primary storage to avoid waste of the memory capacity. Software programs can be distributed by a module unit, and inter-module communication is carried out by the message passing method, so that the same program module can be used commonly over different products which are different from each other in the software specification. Thus, it is possible to eliminate the drawback in the prior art that the program could not be easily replaced even if a new program has the same facility as old one. In the present invention, the inter-module interface is unified by use of the message passing method, so that it is easy to improve the performance of the instrument by updating the software modules, and it is easy to increase a number of facilities by adding software modules. Only the required softwares can be combined with each other since each program is packaged in a module according to the present invention. Also, data such as ABC pattern can be utilized commonly in the form of a software package.

Details of a second embodiment of the present invention will now be described with referring to the drawings.

A1. Hardware Structure

Figure 11:
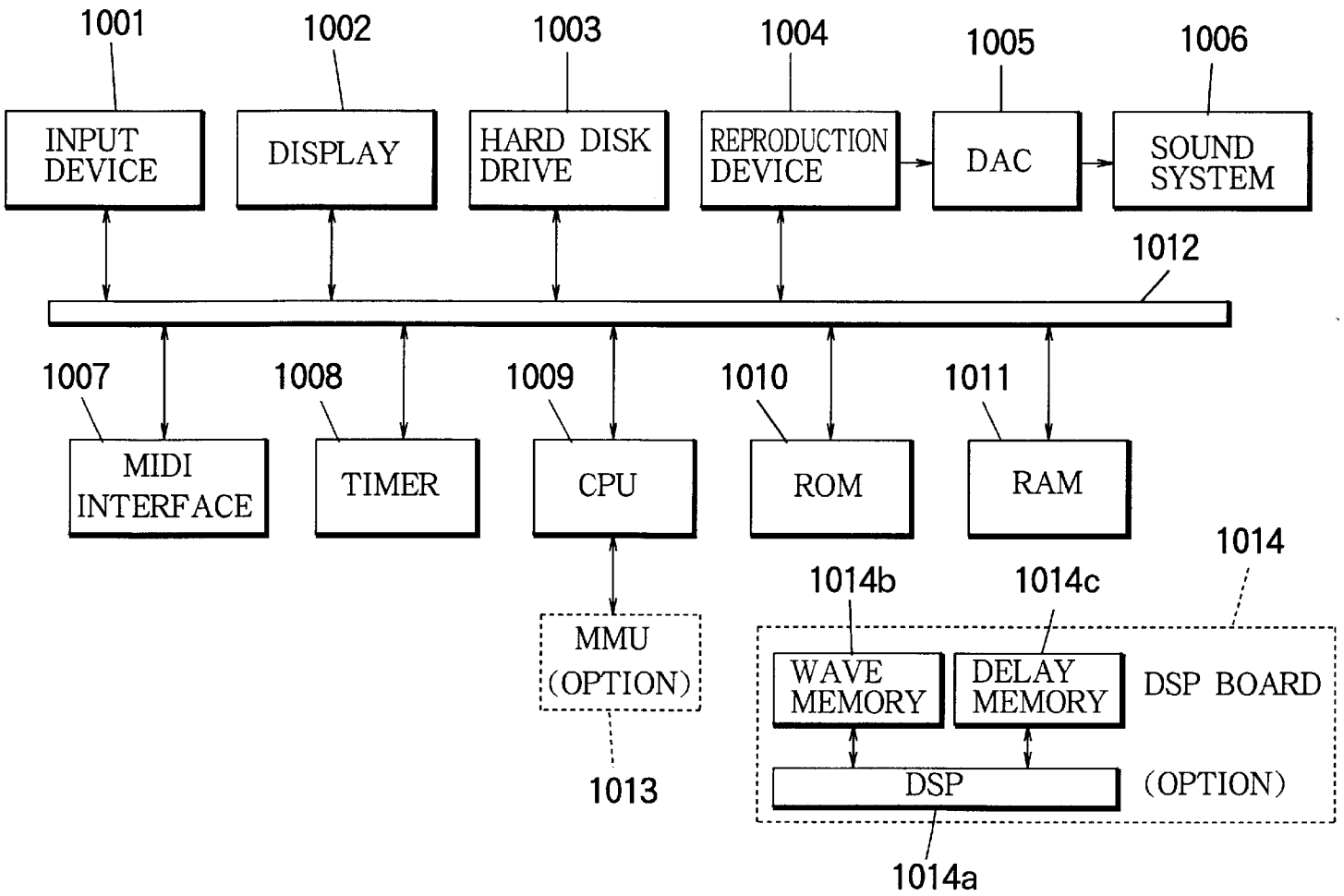
FIG. 11 is a schematic block diagram of the musical tone generating system as a second embodiment according to the present invention.

The hardware configuration of the musical tone generating system according to the second embodiment of the present invention will now be described with referring to Figures. The musical tone generating system according to the second embodiment is implemented on a general purpose computer such as a personal computer. In FIG. 11, numeral 1001 denotes an input device such as a keyboard and a mouse tool. Numeral 1002 denotes a display which displays information distributed through a bus line 1012. Numeral 1003 denotes a hard disk drive which stores an operating system software, various application programs, data utilized by the softwares and so on. Numeral 1009 denotes a CPU to control other devices according to a control program described later. Numeral 1007 denotes a MIDI interface through which MIDI signals are exchanged with external devices. The MIDI interface 1007 interrupts the CPU 1009 upon receiving a MIDI signal from external devices. Numeral 1008 denotes a timer to produce time information. Numeral 1010 denotes a ROM which stores various programs and data such as an initial program loader and character fonts displayed by the display 1002. Numeral 1011 denotes a RAM which can be accessed by the CPU 1009 to read/write data. Numeral 1004 denotes a reproduction device to read out the data stored in a predetermined area of the RAM 1011 and to reproduce the data by generating DMA interrupt to THE CPU 1009. Numeral 1005 denotes a DA converter to convert digital sound data produced by the reproduction device 1004 into an analog sound signal. Numeral 1006 is a sound system to reproduce musical tones according to the analog sound signal.

A2. Optional Hardwares

Additionally to the devices as listed above, the optional hardwares can be attached to the system.

(1) MMU 1013

A MMU (Mathematical Manipulation Unit: co-processor) 1013 can be attached to the CPU 1009.

(2) DSP Board 1014

In this embodiment, the reproduction device 1004 can be replaced by a DSP board 1014. The DSP board 1014 is provided with a DSP (Digital Signal Processor) 1014*a* to execute mathematical operation at high speed with pipeline process, a waveform memory 1014*b*, and a delay memory 104*c*.

A-3. The Layer Structure of the Embodiment

Figure 12:
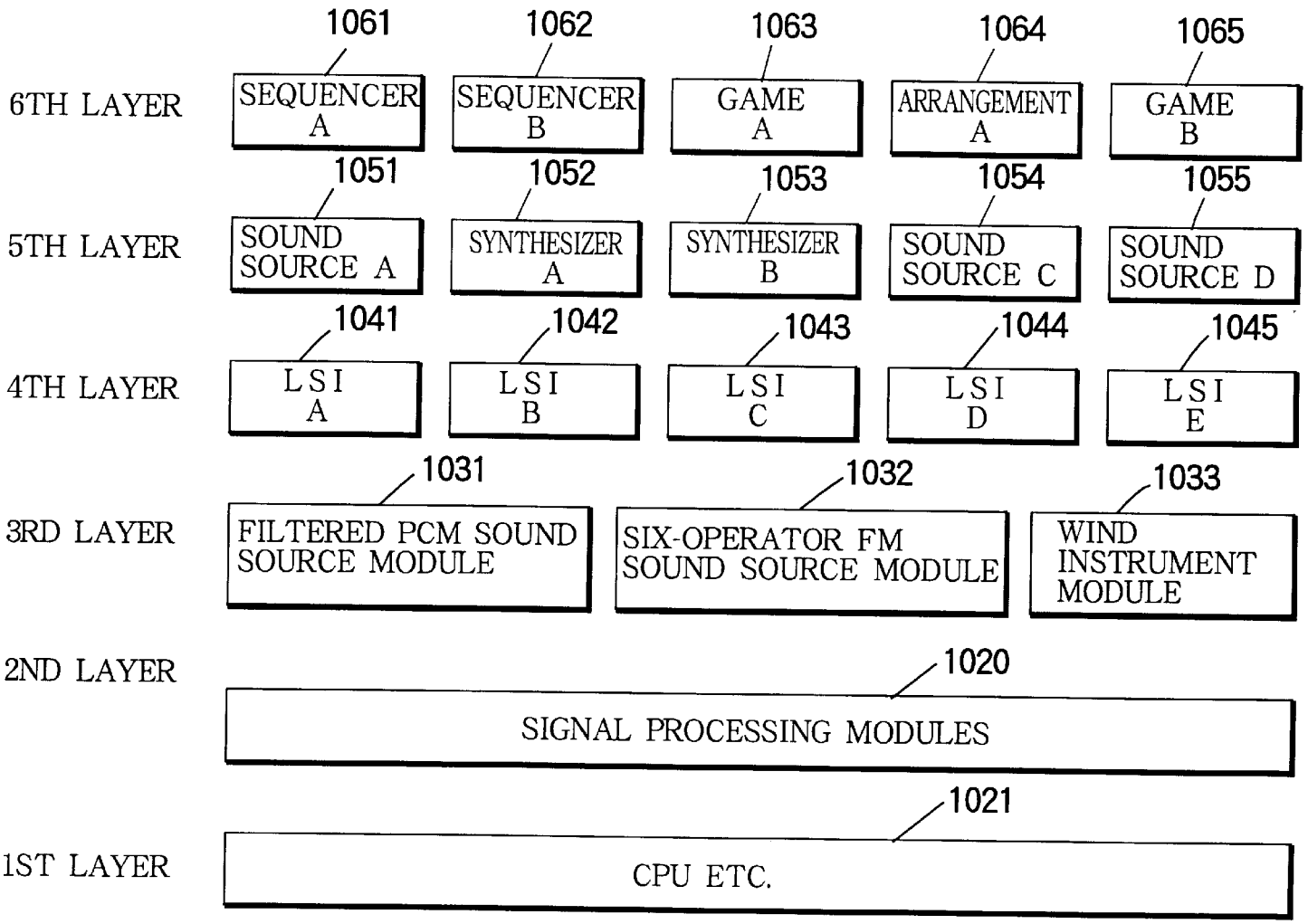
FIG. 12 shows layer structure of softwares installed in the second embodiment according to the present invention.

The layer structure of the hardware and software of the musical tone generating system according to the second embodiment will now be described with referring to FIG. 12. In FIG. 12, a first layer is a physical layer comprised of the hardwares such as CPU 1009. Second to sixth layers are logical layers comprised of softwares which are executed by the CPU 1009. The second layer is comprised of signal processing modules including subroutines to execute primitive signal processings such as four rules of arithmetic operation, bit shift and delay. The third layer is comprised of basic sound source modules or basic tone generator modules to generate waveform data by using the signal processing modules according to various methods. The sound source module will be explained hereunder. Currently, there are various sound source devices which synthesize waveform data according to various methods, including major three types of methods as follows:

A sound source called 'PCM sound source' synthesizes a sound by reading out sampled waveform data of musical sound stored in a memory, and by converting the waveform data into an analog signal.

A sound source called 'FM sound source' comprises a multiple of operators or oscillators, and synthesizes an analog sound signal by frequency-modulating an output signal of one operator with other output signals from other operators, or superimposes output signals from the multiple operators with each other.

A sound source called 'physical model sound source' synthesizes musical sound by simulating behavior of acoustic musical instruments to create digital sound data, and by converting the same into an analog signal.

There are other methods to generate tone s in sound source devices, including high frequency synthesizing method, formant synthesizing method, ring modulation method and so on.

In this embodiment, software modules 1031 to 1033 are installed to generate sound data according to the fundamental methods described above. A PCM sound source module 1031 implements basic operations of circuit blocks included in that kind of a discrete PCM sound source device having filters, and each operation is executed by calling the primitive signal processing modules 1020 in the second layer. An FM sound source module 1032 implements the basic operations of a discrete FM sound source device having six operators. A physical model sound source module 1033 implements or emulates the basic operation of the physical model of acoustic wind instruments. The algorithm of the physical model sound source module varies depending on a kind of a virtual acoustic instrument to be simulated. Therefore, a multiple of the physical model sound source modules 1033 may be required to emulate a physical instrument. By the way, there are various fundamental methods to synthesize musical sound as described above, and actual synthesizing algorithm is slightly different depending on a sound source LSI chip installed in an electronic musical instrument to be emulated, even if the fundamental method is the same. The sound source modules 1031 to 1033 are provided with algorithms emulating the basic operations of the various sound source LSI chips as accurately as possible.

In the fourth layer, pseudo sound sources 1041 to 1045 are provided to emulate the various sound source LSIs. The pseudo sound sources 1041 to 1045 emulate discrete sound source LSIs by commanding selection, combination, or scaling of various control parameters used in the basic algorithm to the sound source modules. The characteristics of a musical sound signal generated by the sound source modules is not only dependent on the hardware configuration of the sound source LSI, but also dependent on a controlling program of the sound source LSI. The controlling program is originally designed to control a specific model of an electronic musical instrument, and varies due to the difference of the softwares. Thus, in the fifth layer, there are provided sound source drivers 1051 to 1055. The sound source drivers 1051 to 1055 emulate the operation of a CPU controlling the LSI chip of a corresponding sound source, and command the pseudo sound sources 1041 to 1045 to emulate the internal processings of the LSI chip, so that the sound source or tone synthesizer is totally emulated. A multiple of the pseudo sound sources 1041 to 1045 may be call ed in case that a model tone generating system to be emulated comprises multiple sound source LSIs.

The sixth layer are provided with application softwares 1061 to 1065 such as sequencers, games and arrangement softwares. The softwares 1061 to 1065 select adequate ones of the sound source drivers 1051 to 1055 in order to generate musical sound according to the algorithm described later. If the optional DSP board 1014 is provided, the processings concerning the first to third layers are executed by the DSP board 1014.

A4. Data Format (1) File Format of the Performance Data

Figure 13A:
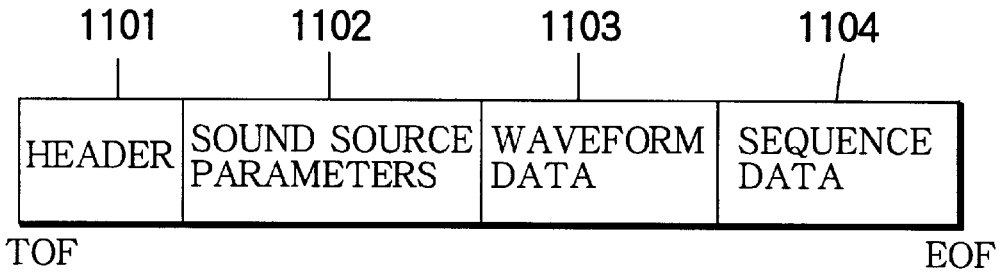
FIGS. 13A–13D show a data format adopted in the second embodiment according to the present invention.

Various data formats utilized in the second embodiment will now be explained with referring to FIGS. 13A–13D. FIG. 13A shows a file of performance data, which is stored in the hard disk 1003. In FIG. 13A, numeral 1101 denotes a header allocated at the to of the performance data file. The header 1101 records information such as a type of the sound source to be emulated, the number and contents of tones used in a song represented by the performance data, timbre codes and so on. The information relating to an emulated sound source includes:

(a) The type of the sound source of the electronic musical instrument to be emulated. Namely, the type refers to PCM sound source, FM sound source, physical model sound source and so on.

(b) The model code of the sound source LSI of the electronic musical instrument to be emulated. One or more of the model code is specified.

(c) The model code of the electronic musical instrument to be emulated.

These data are collectively referred to as device information which indicates devices contained in a tone generating system of the model electronic musical instrument to be emulated.

Numeral 1102 denotes a sound source parameter field, in which control parameters are recorded for each timbre. Generally, the format of the timbre control parameter is different from instrument to instrument. In this embodiment, the format of the control parameters recorded in the sound source parameter field 1102 depends on the type of sound source. The format is identical to the original format of the sound source control parameters of the electronic musical instrument to be emulated.

Numeral 1103 denotes a waveform data field, in which waveform data is recorded to create a desired timbre of musical sound. The waveform data may be a sampling data in case that the sound source of the electronic musical instrument to be emulated is a PCM sound source, or may be a nonlinear function table where data comprised of sampled values are stored in the table addresses in case that the sound source to be emulated is of the physical model type. Numeral 1104 denotes a sequence data field, in which event data of the song is sequentially recorded. The format of the sequence data 1104 may be the same as that of a MIDI data file.

(2) Sound Source Parameter and Waveform Data

Various data formats stored in the RAM 1011 will now be explained with referring to FIGS. 13B–13D.

Figure 13B:
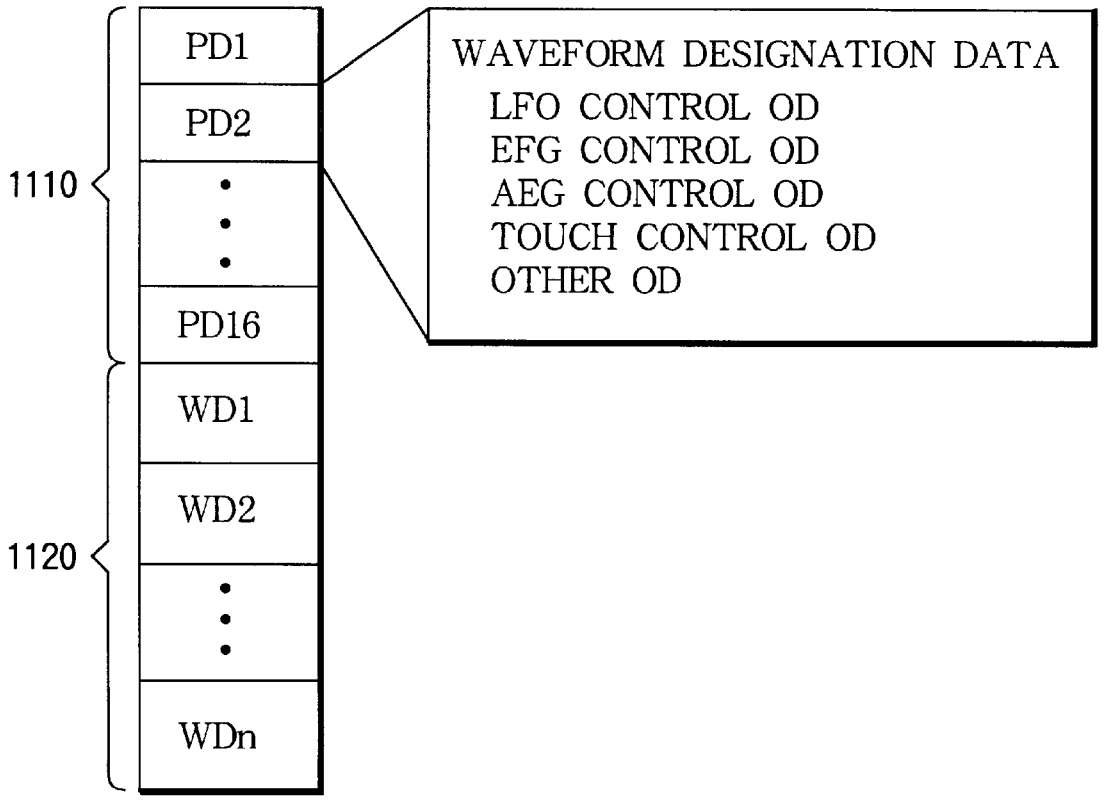

In FIG. 13B, numeral 1120 denotes a waveform data field, in which a plurality of the waveform data WD are recorded. Numeral 1110 denotes a sound source parameter field containing sound source parameters PD1, PD2 . . . PD16 which are separated into 16 parts. Each sound source parameter field is recorded with various parameters to generate various sounds. One set of sound source parameters is shown in an expanded form in this Figure. In this example, the sound source of the instrument to be emulated is the PCM sound source. The parameters include waveform designation data which specifies one of the waveform data. The waveform designation data are different depending on contents of timbre registers. The number of the waveform data may be several times as many as the number of the sound source parameters.

(3) Input Buffer

Figure 13C:
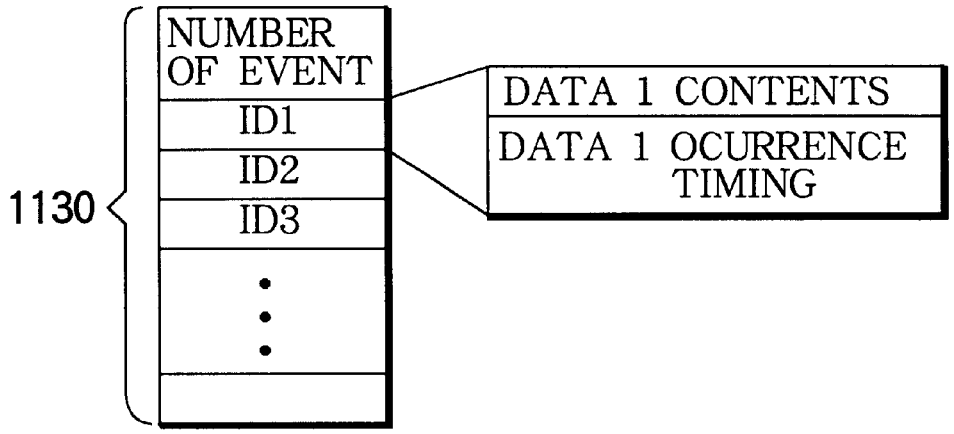

As shown in FIG. 13C, numeral 1130 denotes an input buffer which stores the contents of the sequence data 1104 loaded from the hard disk 1003 or MIDI data inputted through the MIDI interface 1007. The input buffer 1130 stores event data ID1, ID2, ID3 . . . in time series. The number of current event data is recorded at the top address of the input buffer. Each of event data ID1, ID2, ID3 . . . comprises event information (note-on or note-off) and time information indicative of timing when the event has occurred.

(4) Sound Source Register

Figure 13D:
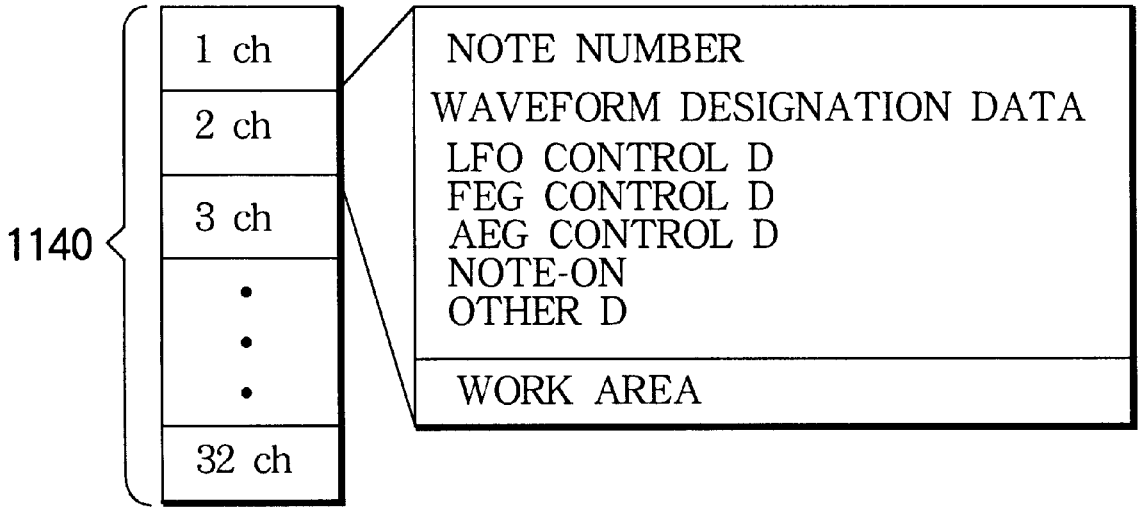

Numeral 1140 denotes a sound source register shown in FIG. 13D. The sound source register 1140 has '32' tone generation channels. One channel of the sound source register is shown in an expanded form as an example wherein the sound source of the instrument to be emulated is the PCM sound source. Each channel of the sound source register records the note number assigned to the channel, the waveform designation data to specify one of the waveform data in the waveform data field 1120, and other data handed to the pseudo sound source. The contents of the sound source register 1140 may be different dependently on the type of the pseudo sound source which is equivalent to a sound source LSI provided in the emulated instrument.

B1. Booting and Initializing the System

Figure 14A:
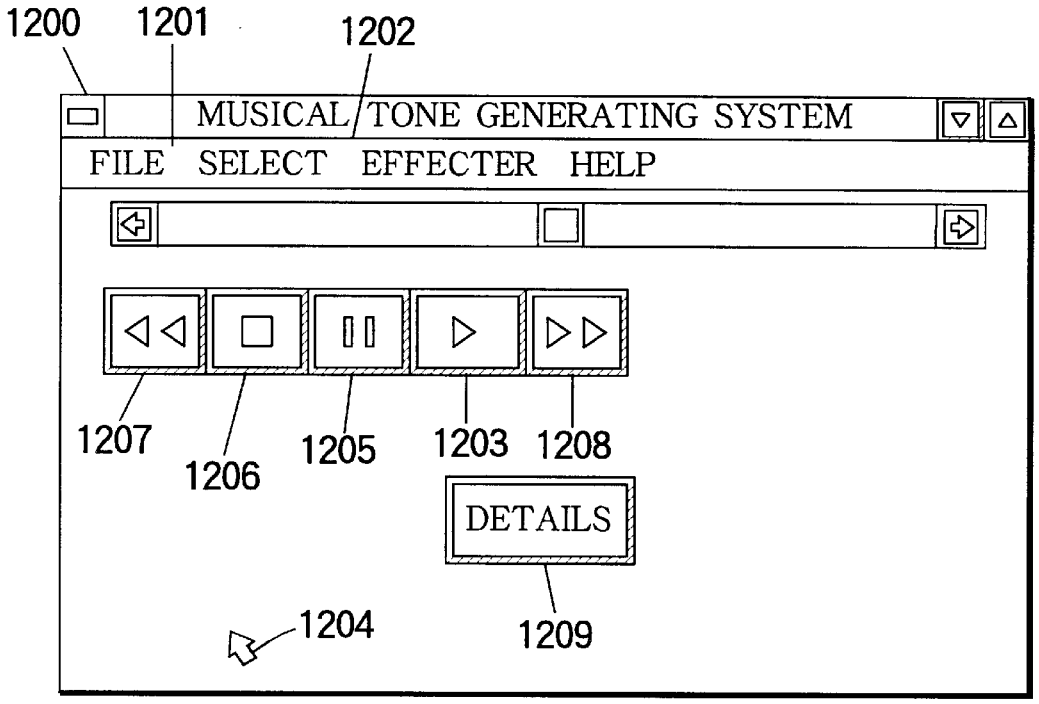
FIGS. 14A and 14B show display examples displayed in a screen of a display device in the second embodiment according to the present invention.
Figure 15A:
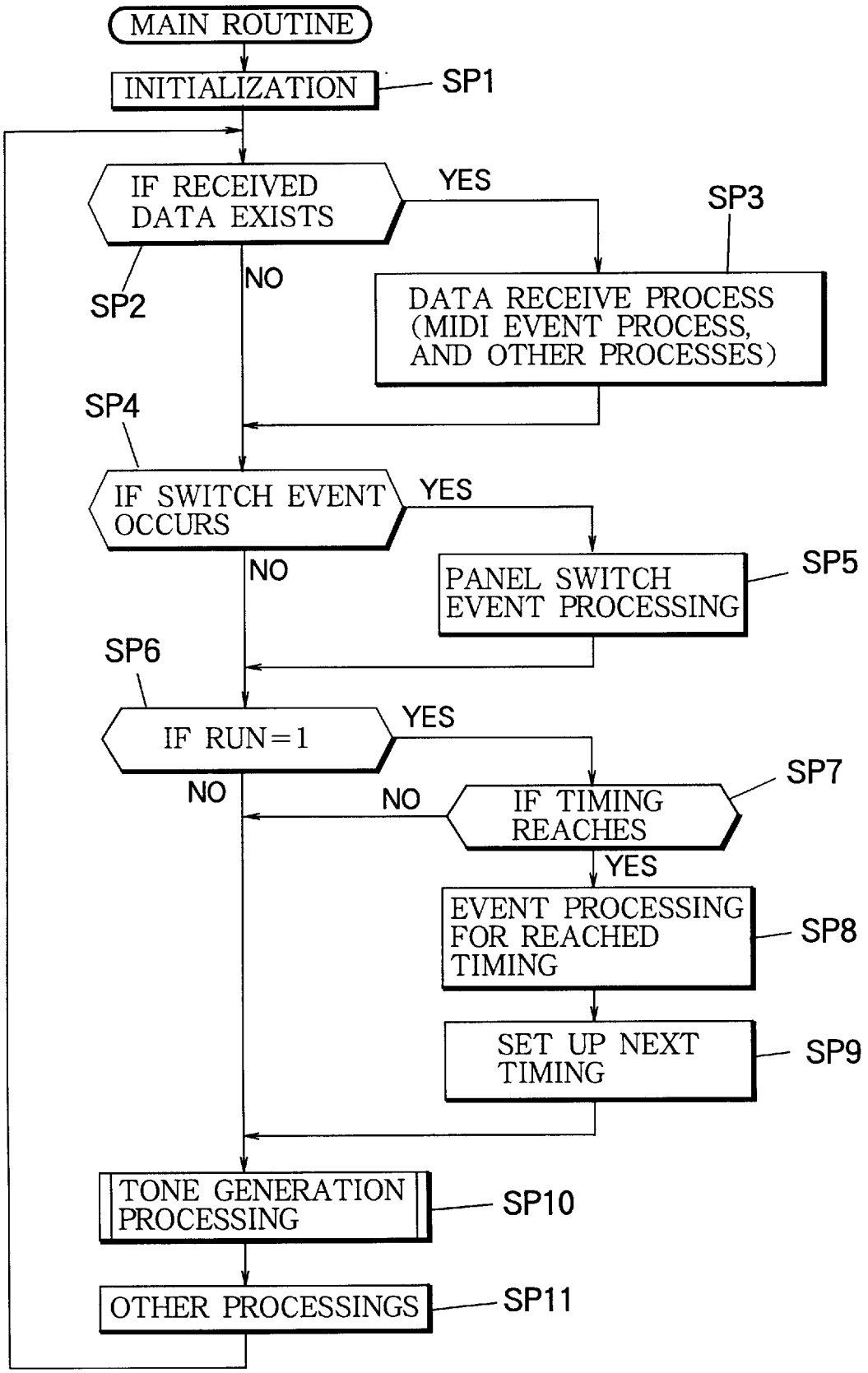
FIGS. 15A and 15B are flowcharts showing a control program executed in the second embodiment according to the present invention.

The operation of the second embodiment will be explained hereunder. The computerized musical tone generating system runs based on a predetermined operating system and based on a shell program (window system). The shell program creates various icons on the display 1002. If the user clicks an icon corresponding to the musical tone generation program by means of mouse tool, a window 1200 is opened on the display 1002 as shown in FIG. 14A. A kernel of the operating system allocates predetermined resources (memory and time slots) for the musical tone generating system in the second embodiment. Then, the main routine of the musical tone generating system is invoked as shown in FIG. 15A. Upon invoking the main program as shown in FIG. 15A, predetermined initialization is done in step SP1. In step SP1, the procedures listed below are executed.

(1) Loading an Initial File

A predetermined directory of the hard disk 1003 accommodates an initial file defining the contents of the initialization in the musical tone generating system. The contents of the initial file are listed below:

(a) Presence/absence of the DSP board 1014, and the type name thereof if the DSP board is present.

(b) Types of a default sound source driver, a default pseudo sound source, and a default basic sound source module.

(c) Settings for the default sound source driver, the default pseudo sound source, and the default basic sound source module.

(d) Default directory for designating the initial file.

(2) Setting Up the Default Sound Source Driver, the Default Pseudo Sound Source, and the Default Basic Sound Source Module In step SP1, the default sound source driver, the default pseudo sound source, and the default basic sound source module are loaded from the hard disk 1003 according to the contents of the initial file. The setup of these resources can be modified by a user input, or by the performance data. The detail of the setup of the sound source driver, pseudo sound source, and basic sound source module is described later.

(3) Other Initializations

After the procedure described above, various initializations are done in step SP1, including setting of initial values in control variables.

B2. Main Loop

Figure 18:
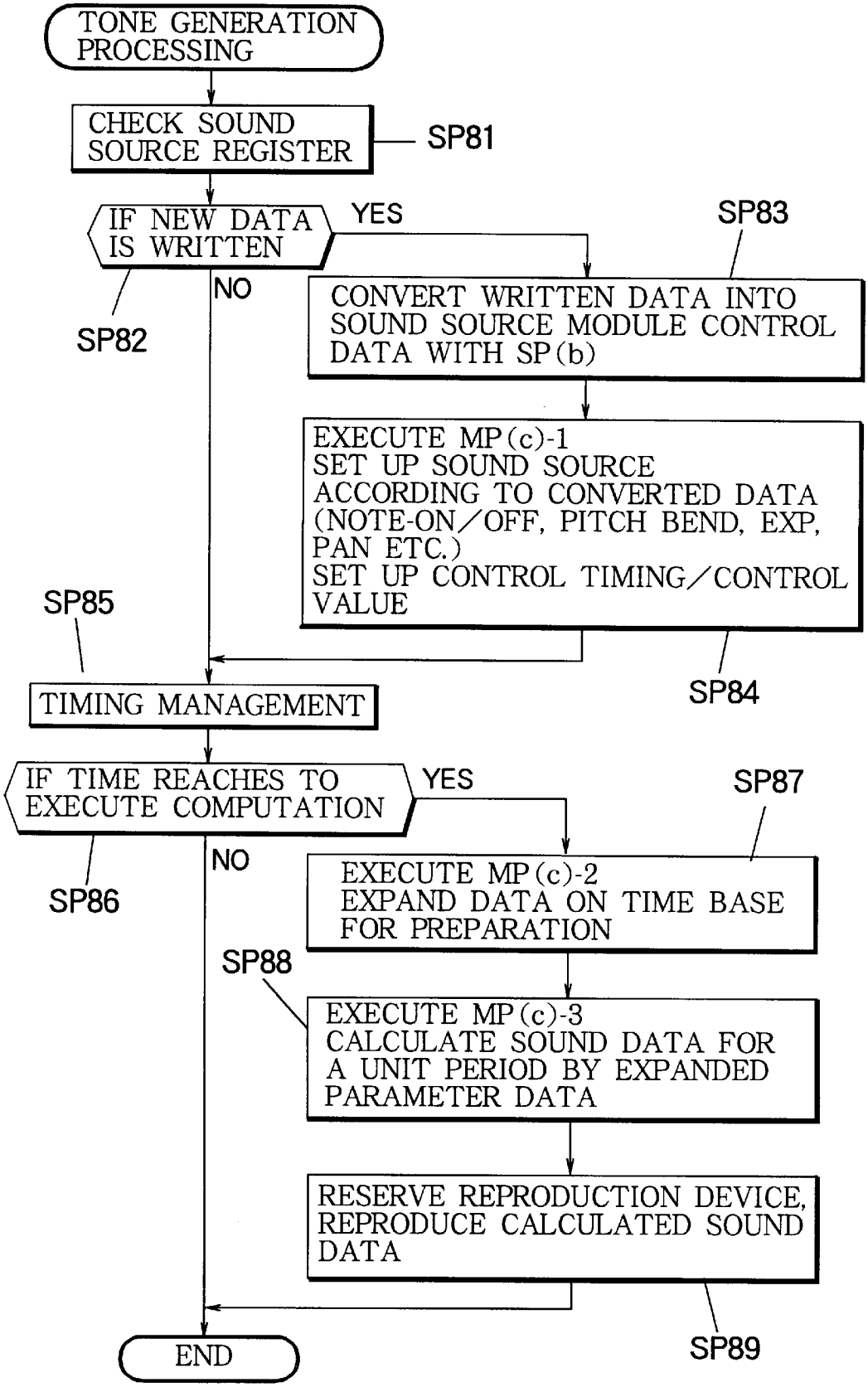
FIG. 18 is a flowchart showing the control program executed in the second embodiment according to the present invention.

After the initialization, the procedure advances to step SP2. In step SP2, the input buffer 1130 is accessed in order to check if new MIDI data arrives through the MIDI interface 1007. If no MIDI data arrives, the procedure advances to step SP4. In step SP4, occurrence of a switch event is detected. The switch event includes a mouse operation event within the window 1200, and a keyboard event in case that the window 1200 is active. If no switch event, the procedure advances to step SP6. In step SP6, a flag RUN is tested if it is "1". The flag RUN indicates whether automatic performance according to the performance data stored in the hard disk 1003 is currently being executed. If no automatic performance is in progress, the flag RUN is "0". Then, the process steps forward to step SP10. In step SP10, a tone generation processing subroutine shown in FIG. 18 is called. However, if the sound source register 1140 does not hold any data at all, the tone generation processing subroutine actually does nothing. The details of the tone generation processing subroutine will be described later. In the following step SP11, other various processings are done. The steps SP2 to SP11 of the main loop are repeated.

B3. MIDI Event Processing

Figure 15B:
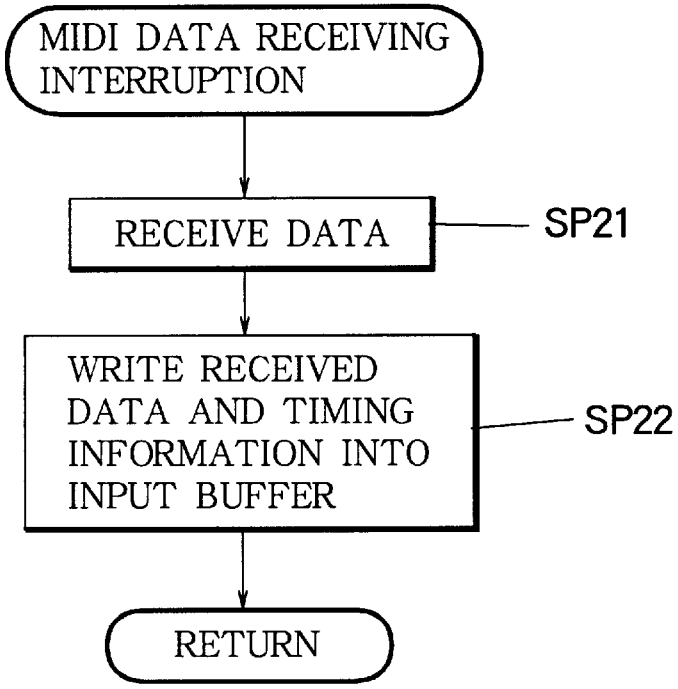

Upon receiving an event data via MIDI interface 1007, an interrupt signal is generated for the CPU 1009, so that the MIDI receiving interrupt routine shown in FIG. 15B is invoked. Upon invoking the routine, the procedure steps forward to step SP21, where the received MIDI data is loaded from the MIDI interface 1007 to a predetermined area of the RAM 1011. In step SP22, timing information is read out from the timer 1008. The received data and the timing information are written at the end of the input buffer 1130. At the same time, the input event counter at the top of the input buffer 1130 is incremented by '1'. After the steps described above are all done, the procedure returns to the routine executed before the interrupt.

Referring back to FIG. 15A, if the procedure again goes to step SP2 with newly received data after the previous procedure of the main loop, the routine branches to step SP3. In step SP3, in response to the newly received data, a note number, note-on and other various data required to synthesize the musical tone are written in the sound source register 1140. The processing executed in case that the received data is note-on will now be described in detail with referring to FIGS. 17A and 17B. In step SP61 of FIG. 17A, the note number, the velocity and the timbre code tn ("n" is one of the part numbers '1' to '16' corresponding to the relevant timbre) are respectively registered in a variable NN, variable VEL, and variable tn. Then, in step SP62, the processing concerning the note-on in the currently selected sound source driver DP(a) (subroutine in the fifth layer) is executed. Particularly, the subroutine shown in FIG. 17B is called.

Figure 17A:
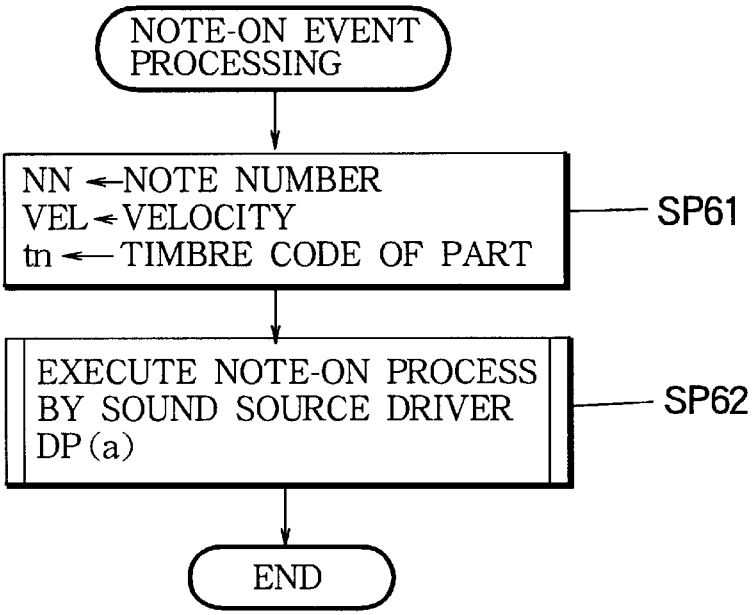
FIGS. 17A and 17B are flowcharts showing the control program executed in the second embodiment according to the present invention.
Figure 17B:
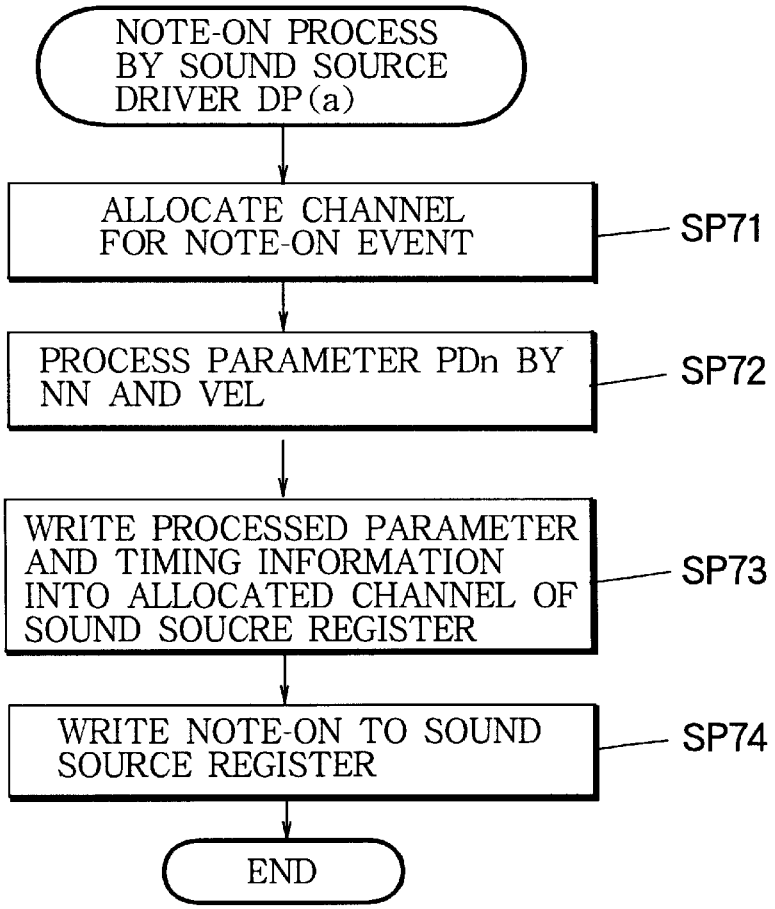

In Step SP71 of FIG. 17B, a vacant tone generating channel of the sound source register is allocated for the note-on event. If the sound source to be emulated is of a type in which a tone is synthesized by two sound sources, two channels are allocated. In step SP72, original parameters PDn ("n" is a part number) is processed according to the note number and the velocity etc. In step SP72, the tone of the instrument is changed not only in the pitch but also in the timbre. Further, the timbre may be changed in response to the operating velocity. For example, the tone of the piano changes due to the key pressure. Thus, in the conventional sound source, the sound source parameters are suitably adjusted according to the note number or the velocity. Likewise, in this embodiment, the sound source parameters are modified with the algorithm similar to the conventional sound source to be emulated. In step SP73, the processed sound source parameters and the occurrence timing of the note-on event are stored in the tone generator channels allocated in advance. The registration of "note-on timing" is one of the significant features of the second embodiment, and is never known in the prior art. The reason why "note-on timing" is registered will be explained later. In step SP74, the note-on is registered to the allocated channel. After the processings above are all done, the procedure returns to the main loop through the note-on event process subroutine. On the occurrence of note-off, pitch bend etc., the similar processings are executed as in the model sound source to be emulated. The various data are registered into the allocated sound source register. In any of the event processings, the registration of "note-on timing" is executed, and this discriminates the inventive computerized sound source from the real sound source to be emulated.

B4. Tone Generation Processing (1) Method of Tone Generation Processing

Figure 19:
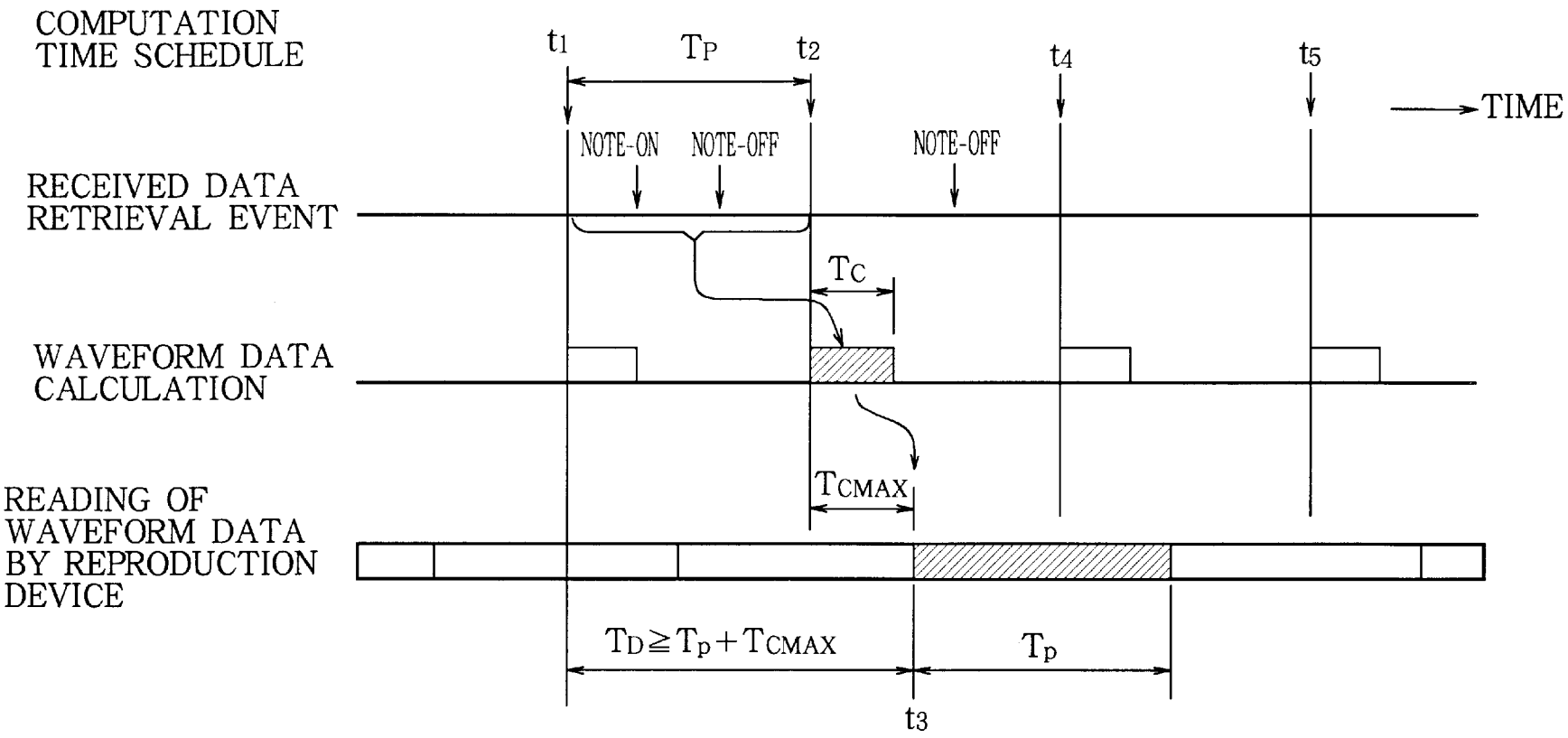
FIG. 19 is a timing chart showing operation of the second embodiment according to the present invention.

Referring back to step SP10 of FIG. 15A, when some data is written in the sound source register (in other words, a certain tone generation channel is allocated to some note event), the actual sounding is executed in the tone generation processing subroutine. Before explaining the details of the tone generation processing subroutine, basic operation method is described with referring to the FIG. 19. Various waveform manipulation processes are required in order to generate the musical tone according to the event data registered in the sound source register 1140. However, executing of the waveform manipulating processes for each event occurrence may occasionally cause trouble. If another event occurs while the waveform manipulating process is executed for one event, the multiple events should be processed at the same time by parallel processing. This situation may cause a variation of the processing time for each event, and may ruin quality of the song data reproduction. Thus, in the present embodiment, a delay due to the time required for the processing is averaged or compensated in order to eliminate the ill effect of the variation of the processing time. For this reason, all the waveform manipulation processes are executed together once every period $T_P$. As shown in FIG. 19, the waveform manipulation processes are sequentially commenced periodically at timings of t1, t2, t4, and t5. Though an individual time $T_C$ required to the waveform manipulation process is different, the maximum value of the time $T_C$ is defined as $T_{CMAX}$. By the way, as mentioned in the foregoing, the sound reproduction device 1004 interrupts the CPU 1009 from time to time to read out the processed waveform data in the RAM 1011, and converts it into the sound signal for reproduction. The memory access of the reproduction device 1004 is successively and intermittently effected at the constant pitch of $T_C$. Thus, the address in which the waveform data is stored and the actual note-on timing of the sound signal are corresponding to each other in a certain relationship. Accordingly, the actual note-on timing is delayed by $T_D(T_D \geqq T_P+T_{CMAX})$. In other words, the processed waveform data is written in the address corresponding to the delayed note-on timing. Thus, if a note-on event occurs within a time slot from t1 to t2, the actual note-on of the event is executed after t3. Usually, the delay time $T_D$ is set approximately to 0.1 sec. As the delay time $T_D$ may vary due to how the constant pitch $T_P$ is set up, it is possible to shorten the synthesized waveform data access interval $T_P$ and to set the delay time $T_D$ to about 0.01 sec, so that the player does not feel unnatural response even if he or she is manually operating an instrument connected to the MIDI interface 1007. As mentioned in the foregoing, it is required to register the adjusted or post-processed sound source parameters, and "note-on timing" in the sound source register. This is required to execute the tone generation processing accurately. In the present embodiment, the timing when an event occurred should be detected in order to take place a note-on at a timing after the delay time $T_D$ is elapsed in response to the event occurrence. In other words, the sound source register in this embodiment is unique in that it does not only emulate a discrete register of a sound source LSI to be emulated, but also memorizes the timing information of event occurrence.

(2) Details of the Tone Generation Processing

The tone generation processing is carried out by calling subroutines belonging to the fourth layer. An example of the process is shown in FIG. 18. In step SP81 of FIG. 18, the content of the sound source register 1140 is searched. In step SP82, it is tested if new data is registered in any register slot or tone generation channel by referring to the results of the search in step SP81. If new data registration is detected in step SP82 ('YES' branch in the Figure), the procedure goes to step SP83, in which a suitable pseudo sound source SP(b) is called to function as a discrete sound source LSI to be emulated. The pseudo sound source SP(b) converts the initial parameter data registered in the sound source register 1140 into effective or equivalent parameter data to control the basic sound source module, and the conversion result is stored in a predetermined area of the RAM 1011. In step SP84, a basic sound source module MP(c) is called. The sound source module MP(c) is divided into sound source submodules MP(c)-1 to MP(c)-3, and the sound source submodule MP(c)-1 is called in step SP84.

In order to prepare for next waveform manipulation processing shown in FIG. 19, the sound source submodule MP(c)-1 sets up various parameters required for the waveform manipulation or synthesis. Namely, the newly registered data would be the event data such as note-on, note-off, pitch bend, expression, pan etc. The detail of the waveform manipulation processing is defined here in this step. For instance, the manipulating process for the pitch bend event is just shifting a pitch. Otherwise, the process for the expression event is just volume change. As shown above, the sound source submodule MP(c)-1 emulates various internal circuit blocks included in a sound source LSI to be emulated, and belongs to the third layer. The processing in the pseudo sound source SP(b), or the sound source submodule MP(c)-1 is executed with respect only to a tone generation channel of the sound source register in which new data is registered.

In steps SP85 and SP86, it is tested if the current time reaches the timing to commence the waveform manipulating process (t1, t2, t4, or t5 in FIG. 19). The procedure returns to the main loop if the test is resulted 'NO'. Upon proceeding to step SP86 after the current time reaches the timing (t), steps SP87 to SP89 are executed. In step SP87, the sound source submodule MP(c)-2 is called. The sound source submodule MP(c)-2 prepares for the waveform manipulating process according to the effective parameters obtained in step SP84. Namely, the various parameters are expanded on the time base. In the following step SP88, the sound source submodule MP(c)-3 is called, and actual sound data is calculated according to the expanded parameters. The processings in the sound source submodules MP(c)-2 and MF(c)-3 generate the musical tone having a level higher than a predetermined value. The processings in the submodules MP(c)-2 and MP(c)-3 are executed with respect to all the note-on channels, and the waveform data within the fixed duration $T_P$ is calculated and synthesized for each channel. The waveform data synthesized for each channel is accumulated in the sound source submodule MP(c)-3, and the sound data for the fixed period $T_P$ is completed as the result of the accumulation. Then, in step SP89, reproduction of the calculated sound data is reserved. The reservation is set up in the reproduction device 1004, so that the succeeding calculated sound data can be reproduced following to the preceding sound data currently reproduced at a timing when the data is to be reproduced. After all the process is executed, the procedure returns to the main loop. Thus, the actual note-on corresponding to each event is realized with the delay $T_D$.

B5. Switch Event Processing

Now, the processing executed on occurrence of the switch event by means of the keyboard or mouse tool in the input device 1001 will be explained. Referring back to FIG. 15A, when a switch event is detected at step SP4, the procedure branches to step SP5, in which the process corresponding to the switch event is executed. The switch event processing will be explained below:

(1) 'File' Button 1201

Figure 16A:
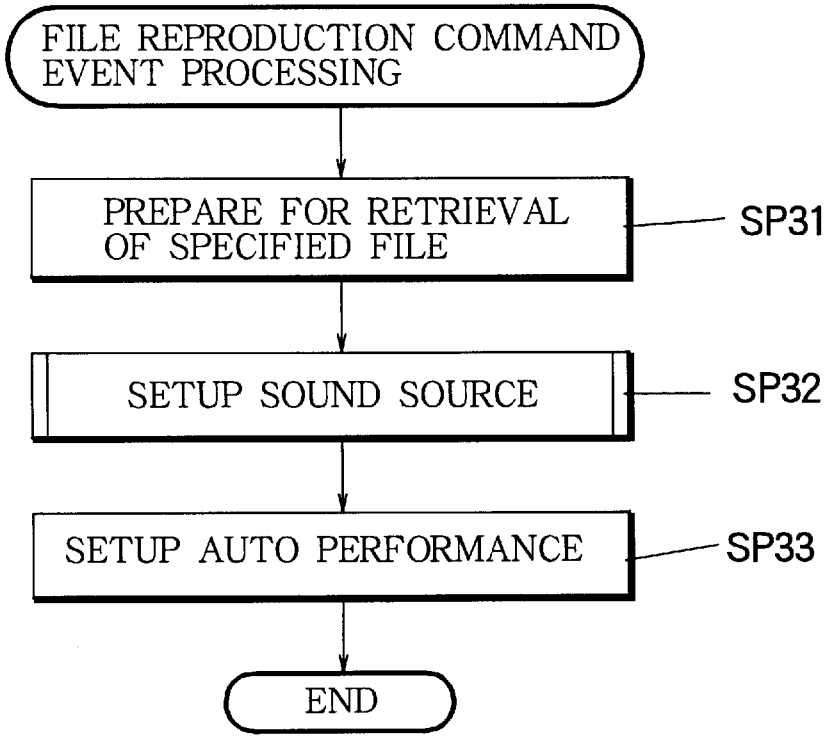
FIGS. 16A–16C are flowcharts showing the control program executed in the second embodiment according to the present invention.
Figure 16B:
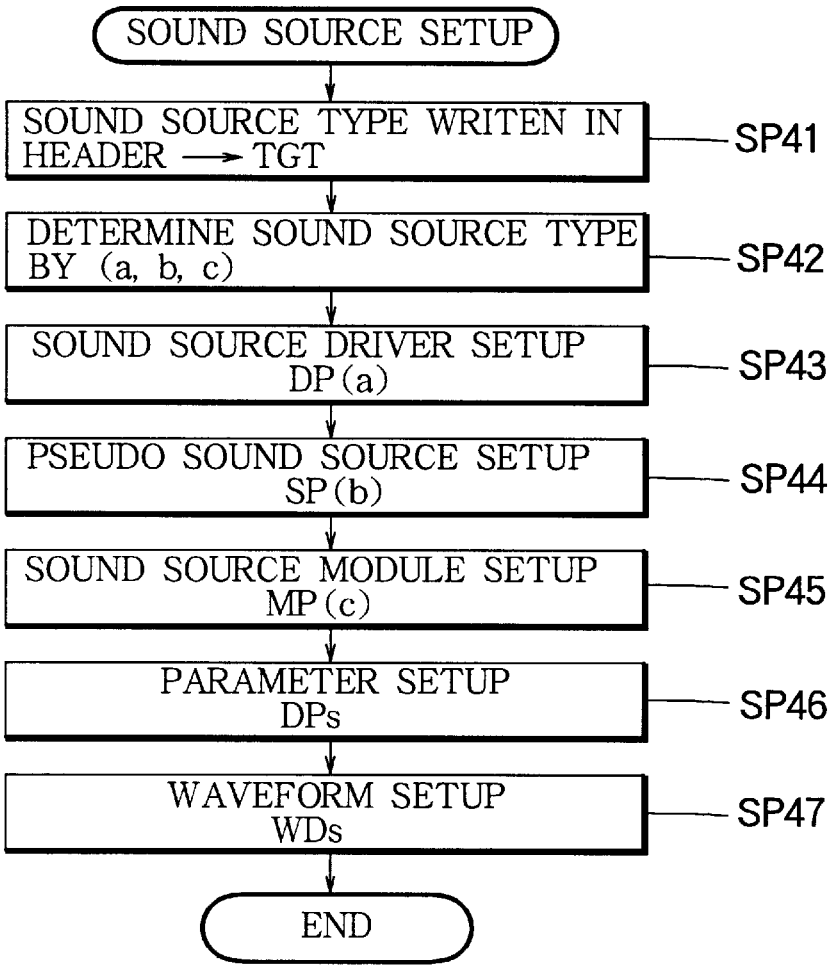

As shown in FIG. 14A, if 'File' button 1201 is clicked by the mouse tool on the window 1200, a file selection window is displayed over the window 1200 on the screen of the display 1002. The file selection window displays the name of the performance data files stored in the predetermined directory (the default directory specified by the initial file). The 'performance data file' is a file having a data format shown in FIG. 13A, and predetermined file extension is attached. If the user moves a mouse pointer 1204 on the displayed file name and double-clicks the mouse tool, the relevant file goes into 'selected' state. Then, the subroutine to handle a data file reproduction command event is executed as shown in FIG. 16A. In SP31 of FIG. 16A, the selected file is prepared for retrieval. In step SP32, the tone generating system or sound source is set up according to the header 1101, the sound source parameter field 1102, and the waveform data field 1103 of the selected performance data file. The setup process for the sound source is shown in FIG. 16B. In step SP41 of FIG. 16B, the 'type of sound source' defined in the header 1101 is registered in a variable TGT. In the following step SP42, the values of the variable TGT is analyzed, and the target sound source is identified. In step SP42, variables a, b, and c are determined according to the identified sound source. The variable a is the model number of the sound source driver, b is the model number of the pseudo sound source, and c is the model number of the sound source module. In step SP43, the sound source driver DP(a) specified by the variable a is set up. The sound source driver DP(a) is loaded from the hard disk 1003 into the RAM 1011. Similarly in steps SP44 and SP45, the pseudo sound source SP(b) and the sound source module MP(c) are read out from the hard disk 1003. Namely, a set of software modules are selected from different layers of the software resource to integratively set up the tone generating system which emulates a sound source of a model electronic musical instrument. In step SP46, multiple sound source parameters are prepared according to the sound source parameter field 1102 of the selected file. The required sound source parameters are expanded on the sound source parameter field 1110 (See FIG. 13B). In step SP47, waveform data specified by the waveform data field 1103 is expanded on the waveform data field 1120. After all the processes mentioned above are finished, the procedure returns to the original caller routine (File reproduction routine in this case).

Returning back to step SP33 of the FIG. 16A subroutine to handle the data file reproduction command event, preparation for automatic performance is carried out. For instance, a predetermined portion of the sequence data 1104 is read out in advance.

By the processings shown in FIGS. 16A and 16B, the initially selected set of the default sound source driver, the default pseudo sound source and the default sound source module are replaced by the new ones according to the device information of the header 1101 and the waveform data field 1103. In the initialization of step S1, a similar procedure as the sound source setup subroutine (FIG. 16B) is executed. However, in step SP41 of FIG. 16B, the type of sound source specified by the header 1101 is stored in the variable TGT, while 'default sound source type' is stored in the variable TGT in the initialization step.

(2) 'Select Timbre' Button 1202

Figure 14B:
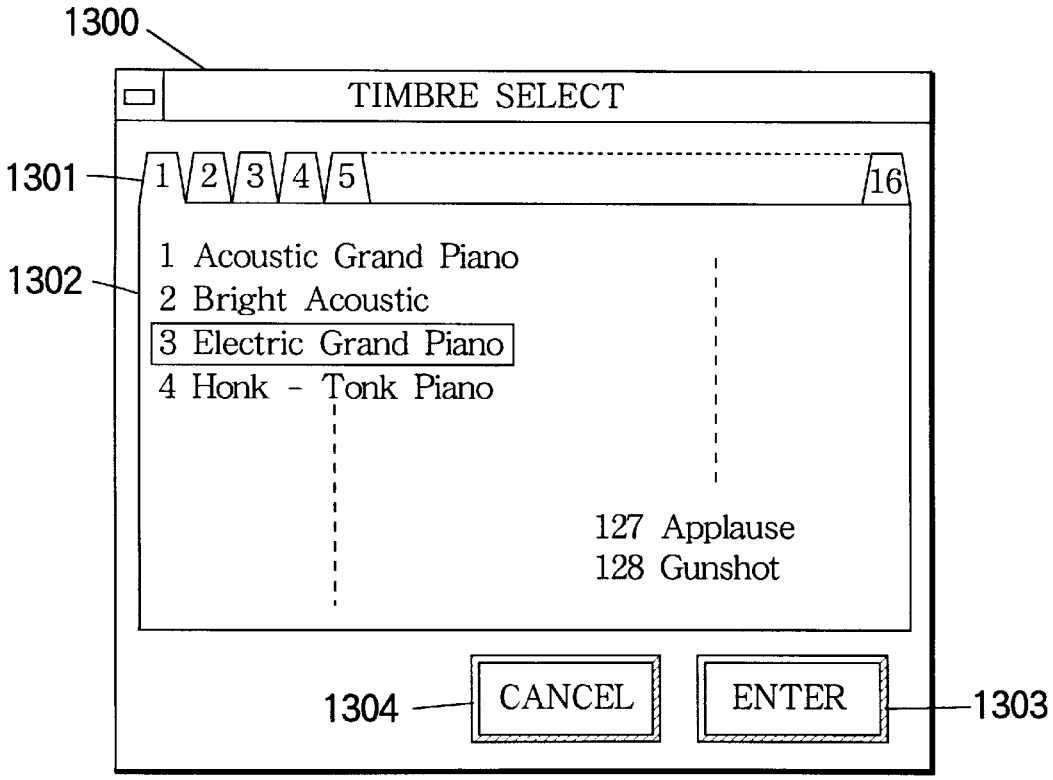
Figure 16C:
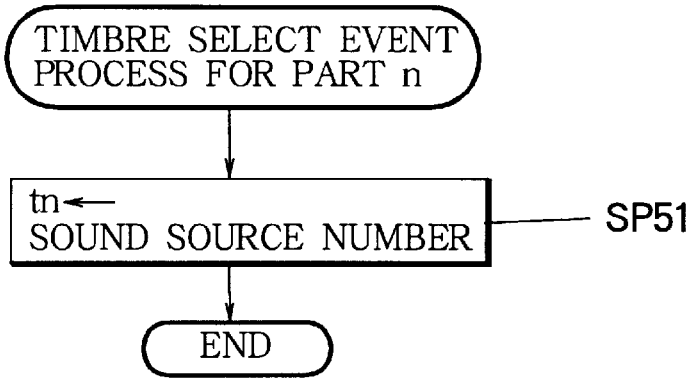

Referring back to FIG. 14A, if the 'select timbre' button 1202 is clicked on the window 1200 with the mouse, a timbre selection window 1300 as shown in FIG. 14B is displayed on the screen of the display 1002. In FIG. 14B, numeral 1302 denotes timbre selection lists, which are provided as many as the number of the channels or parts of the sound source to be emulated ('16' parts are shown in the Figure). Just after the timbre selection window 1300 is displayed, part '1' of the timbre selection lists 1302 is displayed. The timbre selection list 1302 enumerates timbres which can be selected. The currently selected timbre is displayed in a reverse pattern. In the example shown in FIG. 14B, '3 Electric Grand Piano' is selected in the part 1. The number preceding to the name of the timbre is called timbre code. If an area showing another timbre name is clicked with the mouse, the area is reversed, and the portion selected before returns to a normal display (this state is called 'temporal selection'). To change the timbre in a part other than part '1', a preferred part number ('1' to '16') of indexes 1301 is clicked with the mouse, and another timbre selection list 1302 of the relevant part appears in the tone selection window 1300. If a cancel button 1304 is clicked with the mouse after the timbre is selected temporally, the temporal selection state is all canceled. On the other hand, if 'enter' button 1303 is clicked with the mouse, the processing shown in FIG. 16C is executed with respect to each part. The initial timbre code tn ("n" is '1' to '16') set to each part is changed to the temporally selected timbre code. Further, the sound source parameter field 1110 and the waveform data field 1120 are updated in response to the newly selected timbre code tn in step SF51. After the process shown above is done, the procedure returns to the main loop, and the sound data synthesizing is executed according to the newly selected parameters such as sound source parameters.

(3) Start Event Process

Upon clicking the mouse on a 'Play' button 1203 on the window 1200, the flag RUN is set to "1", and then the procedure returns to the main loop of FIG. 15A. Thus, in step SP6 of FIG. 15A, the procedure branches to 'YES' direction to step SP7. In this step, the current time is tested as to whether it reaches the timing to generate a next event in the sequence data 1104 included in the performance data. The event stored at the top of the sequence data 1104 is always discriminated as 'YES' at step SP7. In subsequent step SP8, the event at the top of the cue is processed. The event processing is similar to step SP3 (the processings on the input MIDI signal). For instance, if the top event is note-on, the procedures shown in FIGS. 17A and 17B are executed. In step SP9, the timing to generate a next event is acquired according to the duration data after the top event, and then the procedure returns to the main loop. Thereafter, in step SP7 of the main loop, the current time is tested if it reaches the timing set in advance. If the test result indicates 'YES', the procedure branches to step SP8, and the event processing relevant to the timing is executed.

(4) 'Pause'/'Stop'/'Fast-forward'/'Rewind' Event Processes

Upon clicking 'Pause' button 1205 or 'Stop' button 1206 with the mouse tool, the flag RUN is set to "0" before returning to the main loop. After that, the steps SP7 to SP9 are never executed, and the automatic playing according to the performance data in the system is ceased, and the performance according only to the external MIDI data is reproduced. If 'Fast-forward' button 1208 is clicked with the mouse, the sequence data 1104 is skipped over at high speed. Clicking on 'Rewind' button 1207 results in skipping over the sequence data 1104 in reverse direction.

C. Effects of the Second Embodiment (1) In the second embodiment, the performance data includes not only the sequence data, but also the header 1101, the sound source parameters 1102 and the waveform data field 1103. Thus, various sound sources operating according to various methods can be emulated very accurately.

(2) In the second embodiment above, the 'occurrence timing' of each event is registered in the sound source register, so that the delay of the processing time can be averaged or compensated.

D. Variations

The second aspect of the present invention is not limited within the extent of the second embodiment described above, and can be modified as listed below.

(1) In the second embodiment, the sound source driver, the pseudo sound source and the sound source module are loaded into the RAM 1011 from the hard disk 1003 in case that they are specified by the performance data. However, the frequently used program file containing these softwares may be preloaded into the RAM 1011 in advance. With this preloading, it is possible to cut the overhead of the loading program file relevant to the softwares.

(2) The algorithm of the sound source modules 1031 to 1033 may be modified according to the type of the pseudo sound sources 1041 to 1045. For instance, the number of the operators in the FM sound source module 1032 is '6' in the second embodiment. The number of the operators can be set to '4'. if the number of operators for the sound source to be emulated is '4'. Similarly, if the sound source to be emulated by the PCM sound source module 1031 lacks filtering function, the function may be erased in the PCM sound source module 1031.

(3) In the second embodiment, the pseudo sound source SP(b) is called in step SP83, and the data stored in the sound source register 1140 is converted into the equivalent data effective to control the sound source module. Generally, the converted data is distributed to the sound source modules 1031 to 1033 belonging the third layer, and the data has the same format provided that the method of synthesizing (PCM, FM etc.) is the same, even if the type or product model of the electronic musical instrument or sound source to be emulated is different. Accordingly, the data to control the sound source modules (called 'basic information' hereunder) is very versatile, and can be used commonly for a sound source group employing the same method of synthesizing sound. Thus, the performance data can be exchanged between different platforms of the electronic musical instruments by converting the data through 'basic information'. In other words, the inventive computerized musical tone generating system can be used as a performance data converter. An example is described below wherein first performance information such as timbre information is converted into second performance information. Firstly, the first performance information having the file format as shown in FIG. 13A is converted into 'basic performance information' similarly as in the second embodiment. Then, by reverse converting process, the 'basic performance information' is converted into the second performance information. For this converting method, the bidirectional converting procedure between the specific performance data format in the model instrument and the 'basic performance information' is just required. With this converting method, the performance data file can be shared by many different platforms of the electronic musical instruments.

(4) In the second embodiment, the waveform data of musical tone is synthesized by using the produced 'basic information' as it is. However, the 'basic information' can be edited according to the input operation through the input device 1001. Thus, more colorful musical sound can be generated, thereby overcoming the limitation of the original product model of the sound source or the instrument.

As described in the foregoing, according to the second aspect of the invention, a computerized music apparatus employs device information to specify an electronic musical instrument to be emulated so that it is possible to process performance information of the emulated electronic musical instrument. Further, with setting up an emulative tone generating system according to the device information, it is possible to reproduce musical sound having equivalent characteristics to the emulated instrument. A sound source of the specified electronic musical instrument is emulated in order to generate a musical sound signal waveform, so that it is possible to process the performance information in manner identical to the specified electronic musical instrument. Operations of a processor controlling the sound source of the specified electronic musical instrument are emulated so that the musical sound signal waveform corresponding to various processors can be generated. Operations of control registers storing plural control parameters of the sound source of the specified electronic musical instrument are emulated so that processings according to the contents of the control registers can be commonly used for different electronic musical instruments. The musical tone generation of the sound source of any electronic musical instrument is emulated so that various sound sources operating according to various methods can be emulated very accurately. A single processor selectively emulates operations of various sound sources of electronic musical instruments so that it is possible to emulate many models of electronic musical instruments with an inexpensive arrangement. Further according to the second aspect of the invention, original timbre information is converted into basic timbre information for use in a basic tone generating system which emulates the sound source arrangement of an original electronic musical instrument, so that original timbre information created for a particular model of instrument can be converted into a more versatile format. Optionally, the basic timbre information is converted into timbre information of another electronic musical instrument, so that timbre information created for a particular model of instrument can be translated with high fidelity in another model of instrument. A value of the basic timbre information can be edited through manual operating means, so that colorful musical sound can be generated, thereby overcoming the limitation of a specific model.

What is claimed is:

1. A computerized music apparatus utilizing resources including software modules to generate desired musical sounds, comprising:

a primary storage loadable with a set of software modules which are selected to perform tasks needed in generation of a desired musical sound;

a central processing unit for accessing the primary storage to execute the software modules stored therein to generate the musical sound;

a secondary storage for provisionally storing a plurality of software modules which are designed to perform a variety of tasks, wherein said plurality of software modules include modules of different types and of different species; and a loader operative when the generation of the musical sound is initiated for selecting an effective and optimum set of software modules according to a message issued from one of said different types and different species of software modules by searching the secondary storage according to prescribed criterion, and for loading the selected software modules into the primary storage to thereby ensure effective and optimum use of the resources, and wherein the central processing unit includes means for enabling the software modules to communicate with each other by exchanging a message so as to integratively execute the set of the software modules.

2. A computerized music apparatus utilizing resources including software modules to generate desired musical sounds, comprising:

a primary storage loadable with a set of software modules which are selected to perform tasks needed in generation of a desired musical sound;

a central processing unit for accessing the primary storage to execute the software modules stored therein to generate the musical sound;

a secondary storage for provisionally storing a plurality of software modules which are designed to perform a variety of tasks; and a loader operative when the generation of the musical sound is initiated for selecting an effective and optimum set of software modules by searching the secondary storage according to prescribed criterion, and for loading the selected software modules into the primary storage to thereby ensure effective and optimum use of the resources, and, wherein the loader includes selecting means operative according to a physical criterion for examining hardware modules included in the resources to identify types of effective hardware modules used in the generation of the musical sound, and for selecting effective software modules corresponding to the identified effective hardware modules.

3. A computerized music apparatus utilizing resources including software modules to generate desired musical sounds, comprising:

a primary storage loadable with a set of software modules which are selected to perform tasks needed in generation of a desired musical sound;

a central processing unit for accessing the primary storage to execute the software modules stored therein to generate the musical sound;

a secondary storage for provisionally storing a plurality of software modules which are designed to perform a variety of tasks; and a loader operative when the generation of the musical sound is initiated for selecting an effective and optimum set of software modules by searching the secondary storage according to prescribed criterion, and for loading the selected software modules into the primary storage to thereby ensure effective and optimum use of the resources, and, wherein the loader includes selecting means operative according to a performance criterion if the secondary storage stores two or more of similar software modules performing substantially identical tasks but having different degrees of performance and different ages of creation for selecting optimum one of the similar software modules having either of the highest degree of performance and the youngest age of creation.

4. A computerized music apparatus utilizing resources including software modules to generate desired musical sounds, comprising:

a primary storage loadable with a set of software modules which are selected to perform tasks needed in generation of a desired musical sound;

a central processing unit for accessing the primary storage to execute the software modules stored therein to generate the musical sound;

a secondary storage for provisionally storing a plurality of software modules which are designed to perform a variety of tasks; and a loader operative when the generation of the musical sound is initiated for selecting an effective and optimum set of software modules by searching the secondary storage according to prescribed criterion, and for loading the selected software modules into the primary storage to thereby ensure effective and optimum use of the resources, and, wherein the loader includes selecting means operative according to a first criterion for selecting a software module together with one or more of an indispensable software submodule only if the indispensable software submodule is stored in the secondary storage.

5. A computerized music apparatus utilizing resources including software modules to generate desired musical sounds, comprising:

a primary storage loadable with a set of software modules which are selected to perform tasks needed in generation of a desired musical sound;

a central processing unit for accessing the primary storage to execute the software modules stored therein to generate the musical sound;

a secondary storage for provisionally storing a plurality of software modules which are designed to perform a variety of tasks; and a loader operative when the generation of the musical sound is initiated for selecting an effective and optimum set of software modules by searching the secondary storage according to prescribed criterion, and for loading the selected software modules into the primary storage to thereby ensure effective and optimum use of the resources, and wherein the loader includes selecting means operative according to a second criterion for selecting a software module which is positioned at an upstream of data process flow relative to another software module only if said another software module is stored in the secondary storage.

6. A computerized music apparatus utilizing resources including software modules to generate desired musical sounds, comprising:

a primary storage loadable with a set of software modules which are selected to perform tasks needed in generation of a desired musical sound;

a central processing unit for accessing the primary storage to execute the software modules stored therein to generate the musical sound;

a secondary storage for provisionally storing a plurality of software modules which are designed to perform a variety of tasks; and a loader operative when the generation of the musical sound is initiated for selecting an effective and optimum set of software modules by searching the secondary storage according to prescribed criterion, and for loading the selected software modules into the primary storage to thereby ensure effective and optimum use of the resources, and, wherein the loader includes selecting means operative according to a compatibility criterion for selecting a software module only if the same is compatible with other software modules selected from the secondary storage.

7. A computerized music apparatus utilizing resources including software modules to generate desired musical sound, comprising:

a primary storage loadable with a set of software modules which are selected to perform tasks needed in generation of the desired musical sound;

a secondary storage provided separately from the primary storage for provisionally storing various kinds of software modules which are designed to perform a variety of tasks said various kinds of software modules, including modules of different types and of different species;

a loader operative when the generation of the musical sound is initiated for selecting an effective and optimum set of software modules by searching the secondary storage, and for loading the selected software modules into the primary storage; and a central processing unit for accessing the primary storage to execute the software modules stored therein to generate the musical sound such that the central processing unit enables the software modules to communicate with each other by exchanging a message so as to integrate the set of the software modules altogether.

8. A computerized music apparatus constructed to emulate a tone generating system of a model electronic musical instrument, comprising:

a storage for storing a set of both device information, indicative of devices contained in the model electronic musical instrument, and performance information originally prepared to feed said model electronic musical instrument;

a processor for retrieving the performance information from the storage and for processing the retrieved performance information to produce event information which commands generation of a musical tone; and an emulator operative based on the device information stored in the storage for emulating the tone generating system of the model electronic musical instrument so that the emulator operates in response to the event information to generate the musical tone as if sounded by the model electronic musical instrument.

9. A computerized music apparatus according to claim 8, wherein the emulator includes a driver software module for emulating a driver device involved in the tone generating system so that the driver software module controls the generation of the musical tone.

10. A computerized music apparatus according to claim 8, wherein the emulator includes a register software module for emulating a register device involved in the tone generating system so that the register software module memorizes control parameters used for control of the generation of the musical tone.

11. A computerized music apparatus according to claim 8, wherein the emulator includes a generator software module for emulating a generator device involved in the tone generating system so that the generator software module creates a waveform of the musical tone to be generated.

12. A computerized music apparatus according to claim 8, wherein the emulator comprises a single computer for commonly emulating different tone generating systems of a plurality of model electronic musical instruments.

13. A computerized music apparatus according to claim 8, wherein the emulator comprises means operative based on the device information for integrating a set of software modules corresponding to devices contained in the model electronic musical instrument so as to emulate the tone generating system thereof.

14. A method of emulating an electronic musical instrument by a computer, comprising the steps of:

designating a desired model of electronic musical instruments to be emulated by the computer, the desired model using a sound source parameter to generate a musical tone;

providing event information effective to command the computer to generate a musical tone;

processing the sound source parameter according to the event information with an algorithm of the desired model;

writing the processed sound source parameter into a register which has contents specific to the desired model;

converting the sound source parameter in the register to equivalent parameter data used by a basic tone generating system; and emulating the designated model of the electronic musical instrument by the basic tone generating system so that the computer operates the basic tone generating system in response to the provided event information to generate the musical tone based on the equivalent parameter data as if sounded by the emulated model of the electronic musical instrument.

15. The method according to claim 14, further comprising setting a fixed time slot between an actual timing of generating each musical tone and an occurrence timing of a corresponding one of the event information such that the computer can complete processing of the event information within the fixed time slot.

16. A computerized music apparatus constructed to emulate a timbre created by a model electronic musical instrument, comprising:

first means for setting up a basic tone generating system;

second means for providing an original set of control parameters which characterizes a timbre of musical tones generated by a specific tone generating system of the model electronic musical instrument, the original set of control parameters having a data format unique to the specific tone generating system;

third means for converting the provided original set of control parameters into an equivalent set of control parameters having another format which is effective in the basic tone generating system; and fourth means for providing event information effective to command generation of a musical tone so that the basic tone generating system operates in response to the event information and according to the equivalent set of control parameters for generating the musical tone having an associated timbre as if created by the specific tone generating system of the model electronic musical instrument.

17. A computerized music apparatus according to claim 16, wherein the third means includes optional means for reversely converting the equivalent timbre information into different timbre information which is designed for use in another model electronic musical instrument different from the first-mentioned model electronic musical instrument.

18. A computerized music apparatus according to claim 16, further comprising fifth means manually operable to rewrite values of the equivalent timbre information to modify the timbre created by the basic tone generating system.

19. A computerized music apparatus according to claim 16, wherein the second means comprises means for providing a file of performance data containing the original set of control parameters and device information which designates the specific tone generating system.

20. A method of emulating a timbre created from a model electronic musical instrument by means of a computer, comprising the steps of:

setting up a basic tone generating system in the computer;

providing an original set of control parameters which characterizes a timbre of musical tones generated by a specific tone generating system of the model electronic musical instrument, the original set of control parameters having a data format unique to the specific tone generating system;

converting the original set of control parameters into an equivalent set of control parameters having another format effective in the basic tone generating system; and providing event information effective to command generation of a musical tone so that the basic tone generating system is operated in response to the event information and according to the equivalent set of control parameters for generating the musical tone having an associated timbre as if created by the specific tone generating system of the model electronic musical instrument.

* * * * *